US009743721B1

(12) United States Patent
Jose

(10) Patent No.: US 9,743,721 B1
(45) Date of Patent: Aug. 29, 2017

(54) LOCKING SLIDER ASSEMBLY AND A METHOD FOR ITS MANUFACTURE

(71) Applicant: Boban Jose, San Ramon, CA (US)

(72) Inventor: Boban Jose, San Ramon, CA (US)

( * ) Notice: Subject to any disclaimer, the term of this patent is extended or adjusted under 35 U.S.C. 154(b) by 0 days.

(21) Appl. No.: 15/170,149

(22) Filed: Jun. 1, 2016

(51) Int. Cl.
*A44B 19/24* (2006.01)

(52) U.S. Cl.
CPC ..... *A44B 19/24* (2013.01); *Y10T 24/2513* (2015.01); *Y10T 24/2598* (2015.01)

(58) Field of Classification Search
CPC ..... Y10T 24/2513; Y10T 24/2598; Y10T 24/2534; Y10T 24/2536; A44B 19/24; A44B 19/26
See application file for complete search history.

(56) References Cited

U.S. PATENT DOCUMENTS

| | | | | |
|---|---|---|---|---|
| 853,566 | A | 5/1907 | Sparks | |
| 2,077,350 | A * | 4/1937 | Sundback | A44B 19/04 24/401 |
| 2,416,783 | A | 3/1947 | Vallieres | |
| 2,517,178 | A | 8/1950 | Cheatham | |
| 2,538,616 | A | 1/1951 | Cross | |
| 2,620,535 | A * | 12/1952 | Steiner | A44B 19/14 24/400 |
| 2,718,943 | A | 9/1955 | Braverman | |
| 3,606,372 | A | 9/1971 | Browning | |
| 3,814,220 | A | 6/1974 | Brody | |
| 4,146,045 | A | 3/1979 | Grant | |
| 4,160,496 | A | 7/1979 | Knight | |
| 4,538,709 | A | 9/1985 | Williams et al. | |
| 4,588,056 | A | 5/1986 | Bernbaum | |
| 4,795,186 | A | 1/1989 | Tyus | |

(Continued)

FOREIGN PATENT DOCUMENTS

| | | |
|---|---|---|
| DE | 202009010549 U1 | 10/2009 |
| WO | 0152687 A | 7/2001 |

(Continued)

OTHER PUBLICATIONS

Search Report and Written Opinion mailed Aug. 31, 2016 from International U.S. Appl. No. PCT/US2016/036485 filed Jun. 8, 2016.

(Continued)

*Primary Examiner* — Robert J Sandy
(74) *Attorney, Agent, or Firm* — Law Office of Ilya Libenzon

(57) ABSTRACT

A locking slider assembly includes a rail having a travel direction and a cross-sectional dimension, the rail switchable between a first state in which the cross-sectional dimension has a first value and a second state in which the cross-sectional dimension has a second value, the second value greater than the first value and a slider having a slot that fits over the rail, the slot having a first surface and a second surface, the first surface and second surface separated by a distance aligned with the cross-sectional dimension that is greater than the first value of the cross-sectional dimension and less than or equal to the second value of the cross-sectional dimension, so that the slot can slide over the rail when the rail is in the first state, and the slot cannot slide over the rail when the rail is in the second state.

20 Claims, 17 Drawing Sheets

(56) References Cited

U.S. PATENT DOCUMENTS

| | | | | |
|---|---|---|---|---|
| 4,905,694 | A * | 3/1990 | Will | A61B 17/08 24/390 |
| 5,265,307 | A | 11/1993 | Hull et al. | |
| 5,375,685 | A | 12/1994 | Plath | |
| 5,433,303 | A | 7/1995 | Chen | |
| 5,464,080 | A | 11/1995 | Liang | |
| 5,564,538 | A | 10/1996 | Sadow | |
| 5,699,886 | A | 12/1997 | Latshaw | |
| 5,806,143 | A | 9/1998 | Tsai | |
| 5,904,230 | A | 5/1999 | Peterson | |
| 5,924,533 | A | 7/1999 | Cnockaert et al. | |
| 6,024,264 | A | 2/2000 | Java | |
| 6,105,508 | A | 8/2000 | Ryburg | |
| 6,213,265 | B1 | 4/2001 | Wang | |
| 6,279,706 | B1 | 8/2001 | Mao | |
| 6,540,134 | B1 | 4/2003 | Rasche | |
| 6,543,796 | B1 | 4/2003 | Johnson et al. | |
| 6,564,426 | B1 | 5/2003 | Wang | |
| 6,698,925 | B2 * | 3/2004 | Bentsen | B65D 33/2591 24/400 |
| 6,776,300 | B2 | 8/2004 | Walsh et al. | |
| 6,898,823 | B2 | 5/2005 | Tsai | |
| 7,328,796 | B2 | 2/2008 | Brunson et al. | |
| 7,445,216 | B1 | 11/2008 | Chou | |
| 7,451,861 | B2 | 11/2008 | Bhavnani | |
| 7,617,956 | B1 | 11/2009 | Sabbah | |
| 7,832,532 | B2 | 11/2010 | Nykoluk et al. | |
| 7,845,508 | B2 | 12/2010 | Rothschild et al. | |
| 7,987,955 | B2 | 8/2011 | Puchalski | |
| 8,317,558 | B2 | 11/2012 | Bucknell et al. | |
| 8,613,349 | B1 | 12/2013 | Halko et al. | |
| 8,662,267 | B1 | 3/2014 | Hart et al. | |
| 8,869,960 | B2 | 10/2014 | Mangano | |
| 9,277,796 | B1 | 3/2016 | Elam | |
| 2002/0056736 | A1 | 5/2002 | Conte | |
| 2002/0084159 | A1 | 7/2002 | Hamlin | |
| 2002/0096410 | A1 | 7/2002 | Nykoluk | |
| 2004/0108345 | A1 | 6/2004 | Oh | |
| 2004/0181906 | A1 | 9/2004 | Kuo et al. | |
| 2004/0238304 | A1 | 12/2004 | Fisher | |
| 2005/0011043 | A1 | 1/2005 | Comstock | |
| 2005/0016809 | A1 | 1/2005 | Wu | |
| 2005/0082131 | A1 | 4/2005 | Fenton et al. | |
| 2005/0098402 | A1 | 5/2005 | Cohen | |
| 2005/0183914 | A1 | 8/2005 | Lin | |
| 2006/0037825 | A1 | 2/2006 | Dayton et al. | |
| 2006/0076203 | A1 | 4/2006 | Miller | |
| 2006/0118376 | A1 | 6/2006 | Godshaw et al. | |
| 2006/0272126 | A1 | 12/2006 | Burgess et al. | |
| 2007/0007801 | A1 | 1/2007 | Bishop | |
| 2007/0012593 | A1 | 1/2007 | Kitchens et al. | |
| 2007/0089952 | A1 | 4/2007 | Herbst et al. | |
| 2007/0164064 | A1 | 7/2007 | Nathan | |
| 2008/0078790 | A1 | 4/2008 | Bolling | |
| 2010/0051633 | A1 | 3/2010 | Porte et al. | |
| 2010/0089778 | A1 | 4/2010 | Park | |
| 2010/0313383 | A1 | 12/2010 | Lai | |
| 2011/0209960 | A1 | 9/2011 | MacLean, III et al. | |
| 2010/0282556 | A1 | 11/2011 | Tseng et al. | |
| 2012/0217109 | A1 | 8/2012 | King et al. | |
| 2012/0273314 | A1 | 11/2012 | Raymond et al. | |
| 2012/0325607 | A1 | 12/2012 | Webster et al. | |
| 2013/0032443 | A1 | 2/2013 | Soedomo | |
| 2013/0075213 | A1 | 3/2013 | Chen et al. | |
| 2013/0075214 | A1 | 3/2013 | Chen et al. | |
| 2013/0098410 | A1 | 4/2013 | Prasannakumar et al. | |
| 2013/0153351 | A1 | 6/2013 | House | |
| 2013/0175130 | A1 | 7/2013 | Liang | |
| 2013/0233362 | A1 | 9/2013 | Miller-Klerer | |
| 2013/0264160 | A1 | 10/2013 | Mediamolle | |
| 2014/0151172 | A1 | 6/2014 | Diaz | |
| 2014/0238799 | A1 | 8/2014 | Sharma | |
| 2014/0299428 | A1 | 10/2014 | Gadbois | |
| 2015/0047939 | A1 | 2/2015 | Chang | |
| 2015/0272291 | A1 | 10/2015 | Sener et al. | |
| 2015/0348347 | A1 | 12/2015 | Diz et al. | |
| 2016/0113388 | A1 | 4/2016 | Distefano | |

FOREIGN PATENT DOCUMENTS

| | | |
|---|---|---|
| WO | 2009027992 A2 | 3/2009 |
| WO | 2009039154 A1 | 3/2009 |

OTHER PUBLICATIONS

Search Report and Written Opinion mailed Aug. 31, 2016 from International U.S. Appl. No. PCT/US2016/036494 filed Jun. 8, 2016.

Search Report and Written Opinion mailed May 13, 2016 from International Serial No. PCT/US2016/017464 filed Feb. 11, 2016.

Search Report and Written Opinion mailed May 13, 2016 from International Serial No. PCT/US2016/017470 filed Feb. 11, 2016.

Search Report and Written Opinion mailed May 13, 2016 from International Serial No. PCT/US2016/017475 filed Feb. 11, 2016.

Search Report and Written Opinion mailed May 19, 2016 from International Serial No. PCT/US2016/017447 filed Feb. 11, 2016.

* cited by examiner

LOCKING SLIDER ASSEMBLY AND A METHOD FOR ITS MANUFACTURE

TECHNICAL FIELD

The device and methods disclosed herein relate generally to fasteners, and particularly to a locking slider assembly.

BACKGROUND ART

Slide fasteners such as zippers are used everywhere, on backpacks, handbags, luggage and clothing, as a versatile and reliable way to join two edges of fabric together. Hitherto, however, the convenience of zippers has come at a price: security. Zippers are difficult to lock, and the solutions presented thus far for securing zippers leave a lot to be desired. For instance, one popular way method for locking zippers on luggage is to padlock two sliders of a zipper together, which requires closing the zipper to the point of placing the sliders in close proximity, and attaching a padlock, presumably carried about the person of the user or in a pocket of the luggage item. This is quite inconvenient compared to the process of securing luggage with a latch, which can be performed in a single step without attaching any external equipment.

Therefore, there remains a need for a slide fastener that can be locked quickly and effectively.

SUMMARY

In one aspect, a locking slider assembly includes a rail having a travel direction and a cross-sectional dimension, the rail switchable between a first state in which the cross-sectional dimension has a first value and a second state in which the cross-sectional dimension has a second value, the second value greater than the first value. The locking slider assembly includes a slider having a slot that fits over the rail, the slot having a first surface and a second surface, the first surface and second surface separated by a distance aligned with the cross-sectional dimension that is greater than the first value of the cross-sectional dimension and less than or equal to the second value of the cross-sectional dimension, so that the slot can slide over the rail when the rail is in the first state, and the slot cannot slide over the rail when the rail is in the second state.

In a related embodiment, the rail further includes a top surface, a bottom surface, and a mechanism disposed between the top surface and bottom surface that pushes the top and bottom surfaces apart to change the rail to the second state. In another embodiment, the rail further includes a tube having an exterior including the top surface and bottom surface and an interior containing the mechanism. In a further embodiment, at least one of the top surface and the bottom surface is composed of flexible material. In an additional embodiment, the mechanism includes at least one wedge cam having a cam face forming an angle with the top surface or the bottom surface and an elongated member having at least one bead, the elongated member slidable over the at least one wedge cam, so that sliding the elongated member in a first direction causes the at least one bead to travel up the wedge cam and push the upper surface and lower surface apart. In yet another embodiment, the at least one bead further includes a plurality of beads. In another embodiment still, the at least one wedge cam further includes a plurality of wedge cams.

In an additional embodiment, the elongated member is flexible. Another embodiment also includes a spool to which one end of the elongated member is fixed, so that rotating the spool to a locking position causes the elongated member to slide in the first direction. An additional embodiment includes a latch that secures the spool in the locking position. Yet another embodiment also includes a second locking assembly having a second elongated member, and in that embodiment, an end of second elongated member is also attached the spool. Another embodiment includes a splitter dividing the elongated member and the second elongated member. In another embodiment a portion of the elongated member projects away from the rail. Still another embodiment includes a sheath containing the portion of the elongated member that projects away from the rail. In an additional embodiment, the sheath is flexible.

In an embodiment, the slot is formed by a substantially C-shaped projection attached to the slider. In another embodiment, the rail has a cross-sectional shape, and the slot has a cross-sectional shape that is substantially the same as the cross-sectional shape of the rail. In another embodiment, the slot fits snugly over the rail when the rail is in the first state.

In another aspect, a slide fastener incorporating a locking slider assembly includes a fastener having two flexible strips and a set of interlocking teeth alternately attached to the two flexible strips. The slide fastener includes a rail having a travel direction and a cross-sectional dimension, the rail switchable between a first state in which the cross-sectional dimension has a first value and a second state in which the cross-sectional dimension has a second value, the second value greater than the first value. The slide fastener includes a slider slidably engaged to the fastener, the slider having a mechanism that separates the interlocking teeth when the slider slides in a first direction and interlocks the interlocking teeth when the slider slides in a second direction, the slider also including a slot that fits over the rail, the slot having a first surface and a second surface, the first surface and second surface separated by a distance aligned with the cross-sectional dimension that is greater than the first value of the cross-sectional dimension and less than or equal to the second value of the cross-sectional dimension, so that the slot can slide over the rail when the rail is in the first state, and the slot cannot slide over the rail when the rail is in the second state.

In another aspect, method for manufacturing a locking slider assembly includes obtaining a slide fastener. The method includes attaching to the slide fastener a rail, the rail having a travel direction and a cross-sectional dimension, the rail switchable between a first state in which the cross-sectional dimension has a first value and a second state in which the cross-sectional dimension has a second value, the second value greater than the first value. The method includes incorporating in the slide fastener a slider slidably engaged to the fastener, the slider having a mechanism that separates the interlocking teeth when the slider slides in a first direction and interlocks the interlocking teeth when the slider slides in a second direction, the slider further comprising a slot that fits over the rail, the slot having a first surface and a second surface, the first surface and second surface separated by a distance aligned with the cross-sectional dimension that is greater than the first value of the cross-sectional dimension and less than or equal to the second value of the cross-sectional dimension.

These and other features of the present invention will be presented in more detail in the following detailed description of the invention and the associated figures.

BRIEF DESCRIPTION OF THE DRAWINGS

The preceding summary, as well as the following detailed description of the disclosed system and method, will be better understood when read in conjunction with the attached drawings. It should be understood that the invention is not limited to the precise arrangements and instrumentalities shown.

DETAILED DESCRIPTION OF SPECIFIC EMBODIMENTS

Embodiments of the disclosed locking slider assembly enable a user to secure one or more sliders in place on a slide fastener or similar device; the locking mechanism may lock the sliders in place regardless of the sliders' position along the slide fastener. Some embodiments enable the user to engage the locking mechanism by turning a toggle; the user may be able to lock the toggle in place, and may be able to lock multiple zippers with a single toggle.

Figure 1A:
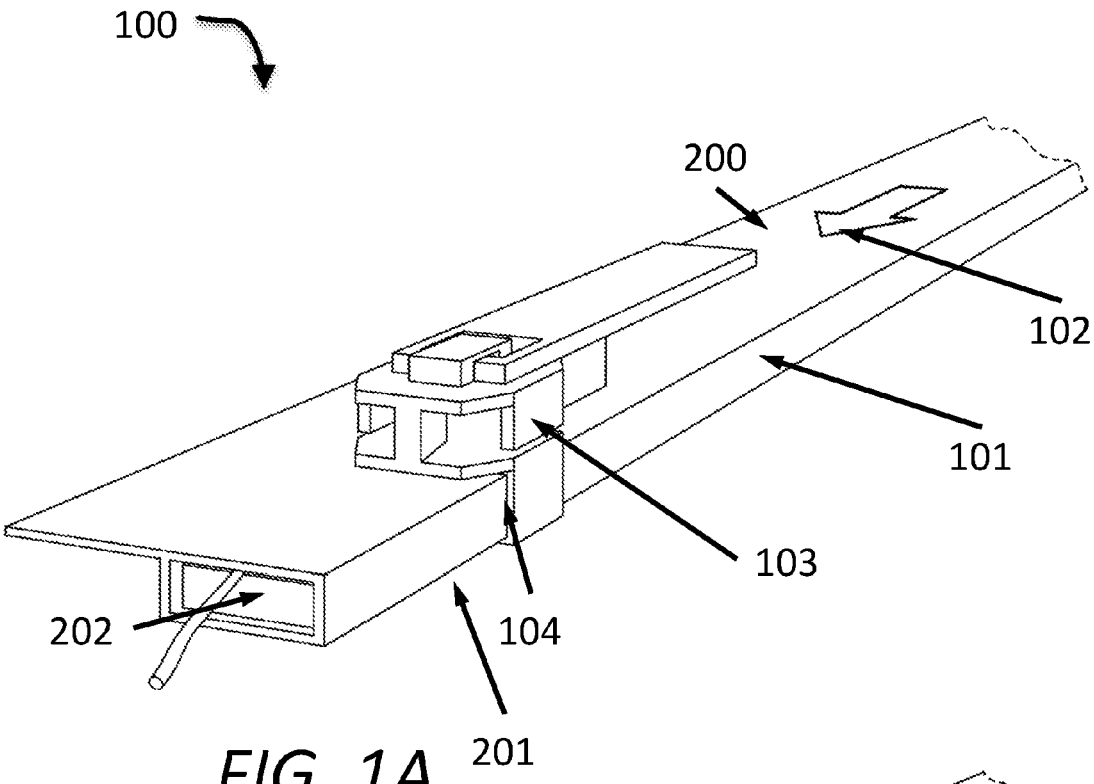
FIG. 1A is a schematic diagram illustrating an embodiment of a locking slider assembly as disclosed herein.
Figure 1B:
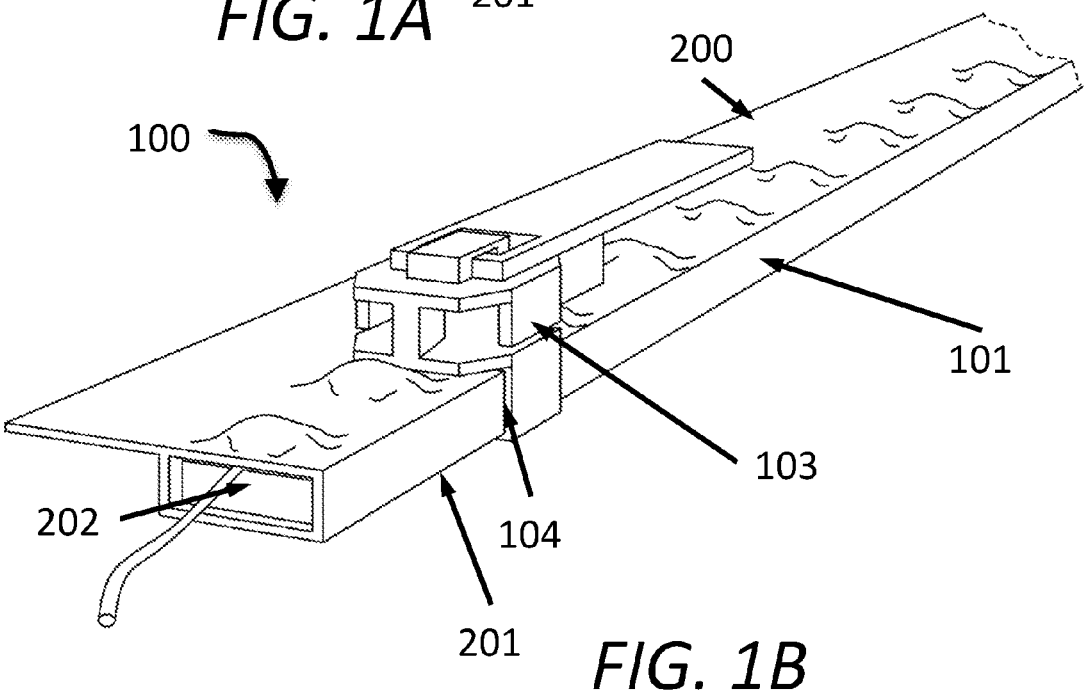
FIG. 1B is a schematic diagram illustrating an embodiment of a locking slider assembly as disclosed herein.
Figure 1C:
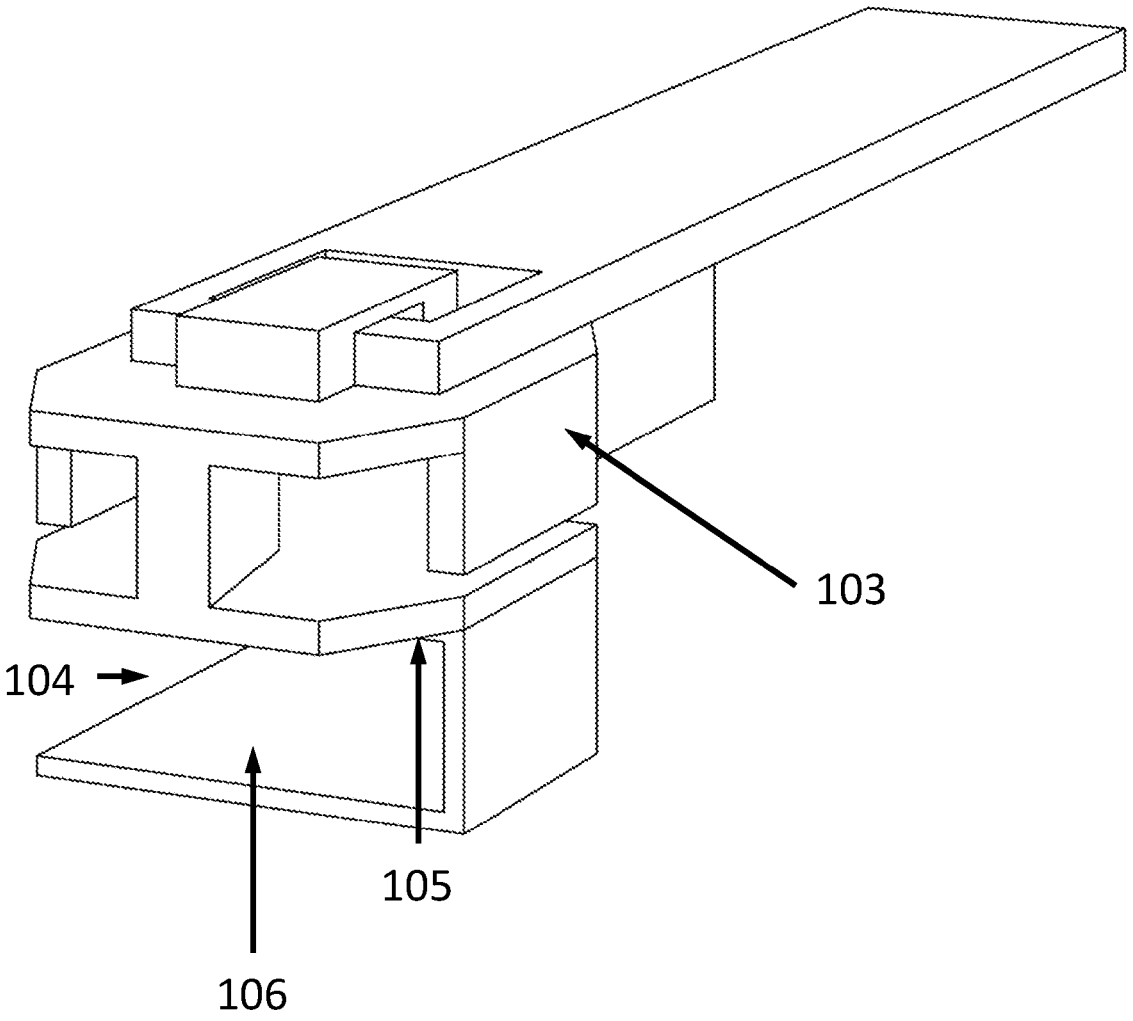
FIG. 1C is a schematic diagram illustrating an embodiment of a slider as disclosed herein.
Figure 1D:
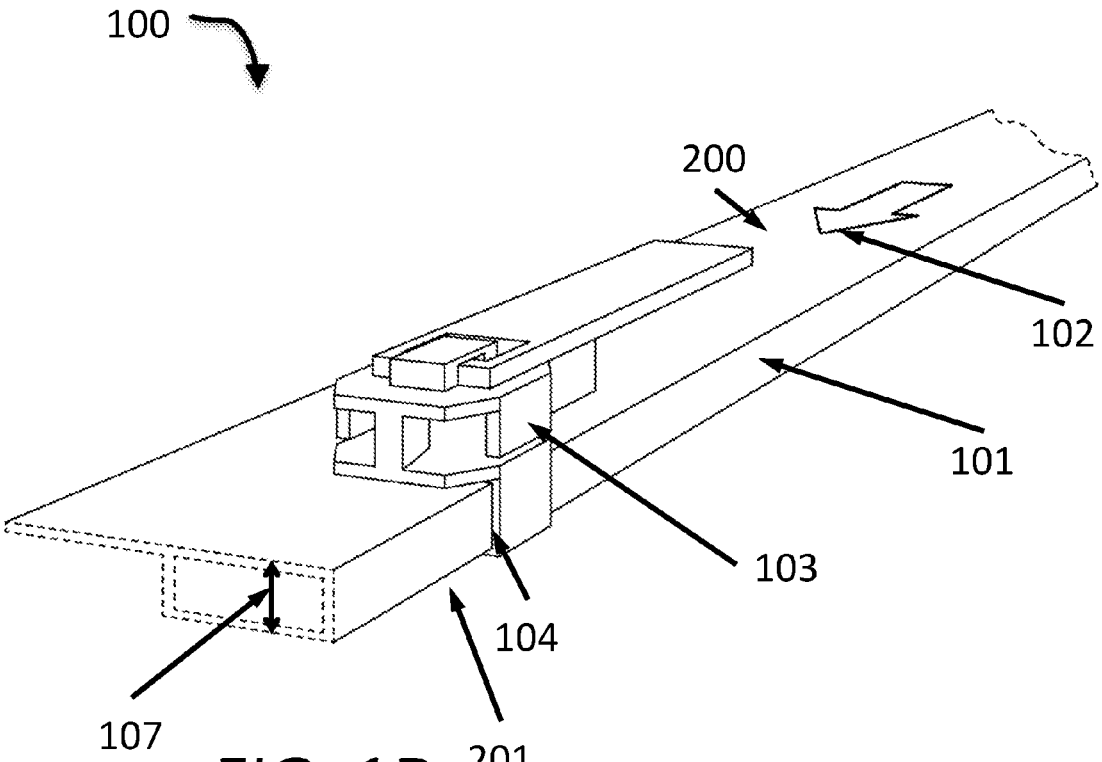
FIG. 1D is a schematic diagram illustrating an embodiment of a partially cross-sectioned locking slider assembly as disclosed herein.
Figure 1E:
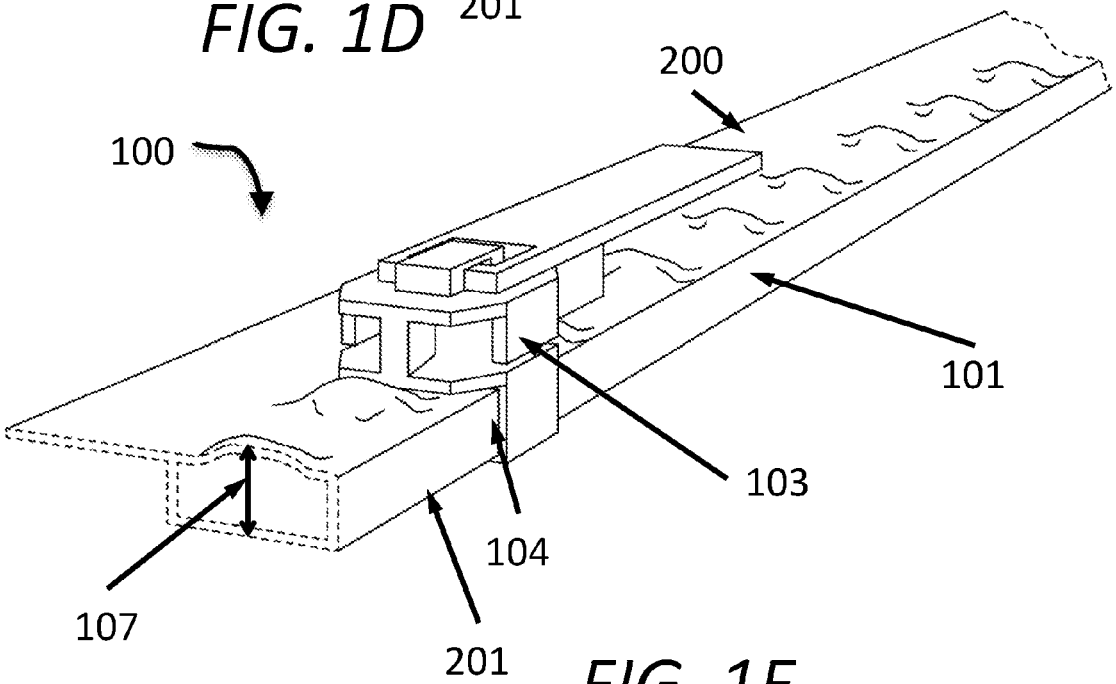
FIG. 1E is a schematic diagram illustrating an embodiment of a partially cross-sectioned locking slider assembly as disclosed herein.
Figure 1F:
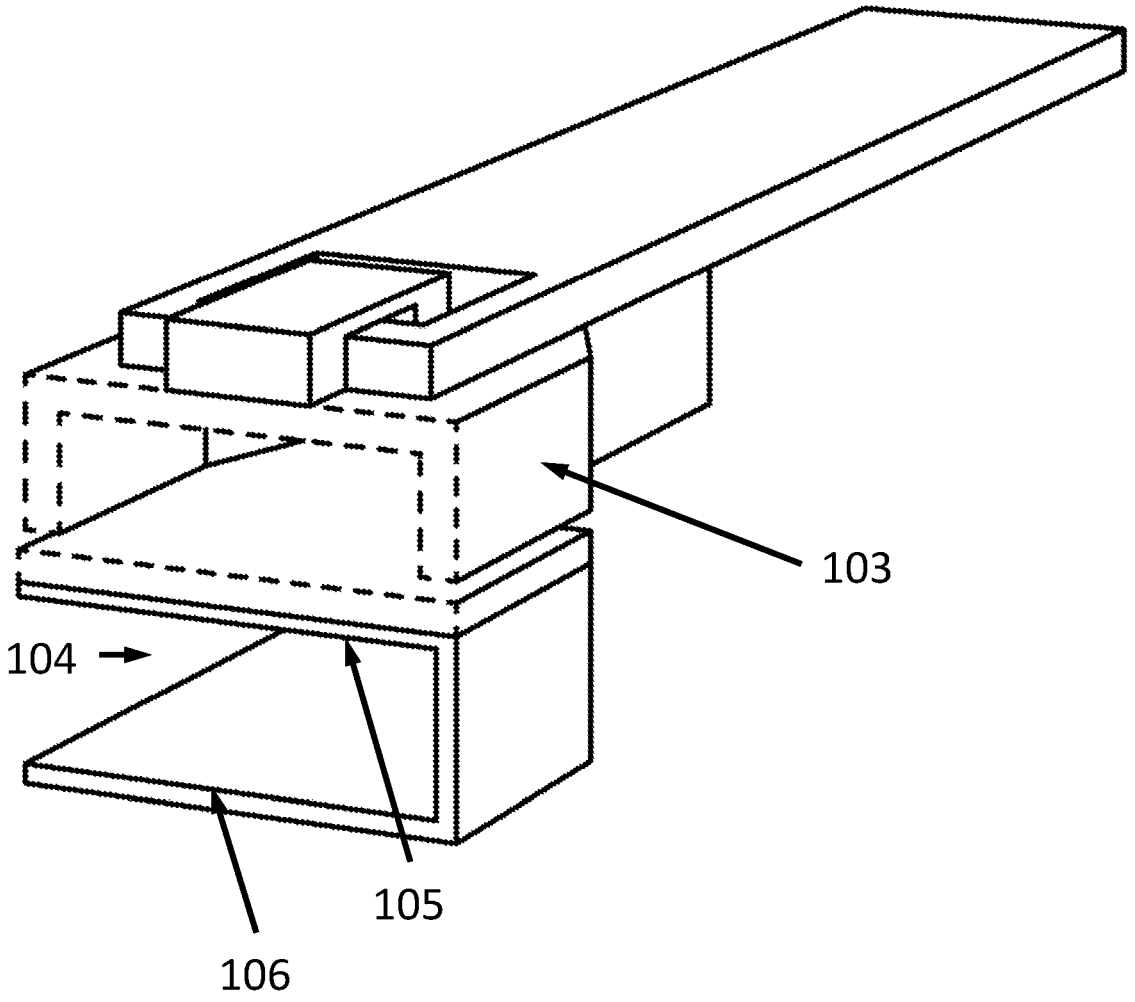
FIG. 1F is a schematic diagram illustrating an embodiment of a partially cross-sectioned slider as disclosed herein.

FIGS. 1A-F depict some embodiments of a locking slider assembly 100. As an overview, the locking slider assembly includes a rail 101 having a travel direction 102. The rail 101 has a cross-sectional dimension 107, as shown in FIGS. 1D-E. The rail 101 is switchable between a first state in which the cross-sectional dimension 107 has a first value, as shown for example in FIGS. 1A and 1D and a second state in which the cross-sectional dimension 107 has a second value, as shown for instance in FIGS. 1B and 1E, the second value greater than the first value. The assembly includes a slider 103. The slider 103 includes a slot 104 that fits over the rail 101. The slot has a first surface 105 and a second surface 106. The first surface 105 and second surface 106 are separated by a distance aligned with the cross-sectional dimension that is greater than the first value of the cross-sectional dimension and less than or equal to the second value of the cross-sectional dimension. As a result, the slot 104 may be able to slide over the rail 101 when the rail 101 is in the first state, and the slot 104 may be unable to slide over the rail 101 when the rail 101 is in the second state.

Viewing FIGS. 1A-C in greater detail, the rail 101 may be an elongated structure along which the slider 103 can travel by sliding. The rail 101 may have a substantially uniform width and depth throughout its length, when in the first state. The rail 101 in the first state may have any suitable cross-sectional form. The cross-section of the rail 101 may have a substantially polygonal perimeter, which may be regular or irregular; for instance, the perimeter of the cross-section of the rail 101 may be substantially rectangular. The perimeter of the cross-section of the rail 101 may have a substantially curved form; for instance the perimeter may have a substantially circular or elliptical shape. The perimeter may combine straight and curved forms; for instance the perimeter may be substantially rectangular with rounded corners, or combine parts of an elliptical curve with polygonal straight portions. The length of the rail 101 may be arbitrarily great: for instance, the rail 101 may be as long as any slide fastener in which the locking slider assembly 100 is incorporated as described below.

The rail 101 may be composed of any suitable material or combination of materials. The rail 101 may be composed at least in part of substantially flexible material; for instance, the rail 101 may exhibit similar flexibility to a slide fastener in which the locking slider assembly 100 is incorporated as described in further detail below. The flexible material may include a natural polymer such as rubber or an artificial polymer such as a flexible or elastomeric plastic. The flexible material may include a natural or artificial textile material. The flexible material may include a natural or artificial membranous material, such as leather. The rail 101 may be composed in part of rigid material; for instance, the rail 101 may include one or more rigid sections. The rigid material may include without limitation metal, rigid plastic, wood, or fiberglass.

The rail 101 has a cross-sectional dimension 107. The cross-sectional dimension may be any dimension substantially orthogonal to the travel direction 102; for instance, the cross-sectional dimension may be a height of the rail 101, for instance as illustrated in FIGS. 1A-B and 1D-E, a width of the rail 101, a diameter across the rail 101 as illustrated in FIGS. 2E-2H or any other dimension measurable between two points on a cross-section of the rail 101 where the cross-section is taken to be substantially orthogonal to the travel direction 102. The rail 101 may be switched between two states, as illustrated in FIGS. 1A-B and FIGS. 1D-E. The dimension 107 is greater in the second state, as illustrated for instance in FIGS. 1B and 1E than in the first state, as illustrated for example in FIGS. 1A and 1D; in other words, in the direction of measurement of the dimension 107 the rail 101 may expand when switching from the first state to the second state. The expansion may not be uniform along the length of the rail 101; for instance, the expansion may occur at a series of substantially evenly spaced locations along the rail 101, leaving the area between those locations relatively unchanged. In some embodiments, as illustrated for instance in FIGS. 2E-F, the dimension 107 expands without increasing the total circumference of the cross-section of the rail 101 where the expansion occurs; in other words, the increase in the dimension 107 is matched by a decrease in a second dimension, for instance turning the circular cross-section of a cylindrical tubular rail 101 into an elliptical cross-section, at least where the dimension 107 is being modified. In other embodiments, as illustrated for instance in FIGS. 2G-H, the total circumference of the cross-section increases when the dimension 107 increases; in other words, a second dimension may stay the same or increase as well.

FIGS. 2A-D depict side views of an embodiment of the rail 101 in the first and second states, respectively. In some embodiments, as shown in, the rail 101 includes a top surface 200. The rail 101 may include a bottom surface 201. In some embodiments, the height of the rail 101 is the distance from the bottom surface 201 to the top surface 200. The rail 101 may change its height from the first state to the second using a mechanism 202 disposed between the top surface and bottom surface that pushes the top and bottom surfaces apart to change the rail to the second state. In some embodiments, as shown in FIGS. 1A-B, the rail includes a tube having an exterior including the top surface and bottom surface and an interior containing the mechanism 202. In some embodiments, at least one of the top surface 200 and the bottom surface 201 is composed at least in part of flexible material. Returning to FIGS. 2A-B, the mechanism 202 may include at least one wedge cam 203. The wedge cam 203 may have a cam face 204 forming an angle with the top surface 200. The cam face 204 may alternatively form an angle with the bottom surface 201 or the bottom surface. The at least one wedge cam 203 may be constructed of substantially rigid material. The at least one wedge cam 203 may be attached to the rail 101 or may rest inside the rail 101. For instance, where the rail 101 is a tube, the at least one wedge cam 203 may rest inside the tube; the at least one wedge cam 203 may be attached to a surface of the interior of the tube. The at least one wedge cam 203 may be a part of an elongated structure such as a strip that sits inside the tube; the elongated structure may be attached to a surface of the interior of the tube. The at least one wedge cam 203 include a plurality of wedge cams; for instance, the at least one wedge cam 203 may include a plurality of wedge cams incorporated in a long strip of material that is placed inside the tube. The at least one wedge cam 203 may be a flat planar wedge; in other embodiments, the at least one wedge cam 203 has a conical or otherwise curved cam face 204; the cam face 204 may extend all the way around the wedge cam 203 when the wedge cam 203 is conical.

The mechanism 202 may include an elongated member 205. The elongated member 205 may be slidable over the at least one wedge cam 203; for example, the elongated member may rest on top of the at least one wedge cam 203. In some embodiments, the elongated member 205 is flexible; for instance, the elongated member 205 may be or include a wire, such as a plastic or metal wire. The elongated member 205 may include or be a string or yarn. The elongated member 205 may include or be a cable, such as a cable suitable for use in bicycle brakes or similar devices.

The elongated member 205 may have at least one bead 206. In some embodiments, a bead 206 is a physical object, attached to the elongated member 205, that has a greater cross-sectional area than the elongated member 205. In some embodiments, the elongated member passes through the bead 206; for instance, the bead 206 may have a hole through it, through which the elongated member 205 is strung, similarly to a necklace. The bead 206 and elongated member 205 may also be manufactured together; for instance, the bead 206 and elongated member 205 may be extruded or molded together. In some embodiments, the at least one bead 206 is affixed to the elongated member 205; in other words, the bead 206 may not slide along the elongated member 205. The at least one bead 206 may have any shape, including a substantially spherical shape, a spheroidal shape, a regular or irregular polyhedral shape, or any combination of curved and polyhedral forms; for instance, the at least one bead 206 may have a form that presents a concave surface to a convex cam face 204, or the bead 206 may have a form that presents a convex surface to a concave cam face 204. The at least one bead 206 may be a plurality of beads; there may be a bead resting near each wedge cam 203. In some embodiments, sliding the elongated member 205 in a first direction 207 causes the at least one bead 206 to travel up the wedge cam 203 and push the upper surface 200 and lower surface apart 201. The upper surface 200, lower surface 201 or both may deform where each bead 206 is riding up the cam surfaces 203, increasing the height of the rail 101 at that point; in some embodiments, increasing the height of the rail 101 at least at one point along the rail 101 is increasing the height of the rail. The result of the elongated member 205 being pulled or pushed in the first direction 207 thus may be to create a series of lumps or similar protrusions in the top surface 200 or bottom surface 201 of the rail, blocking the slot 104 from sliding over the rail, for instance as illustrated in FIG. 1B. In some embodiments, the mechanism 202 includes more than one elongated member 205 with beads 206; the plurality of elongated members 202 may be coupled in parallel so that a force pulling one in the first direction pulls the others as well. As a result, the rail 101 may expand in more than one dimension at the same time.

Figure 2A:
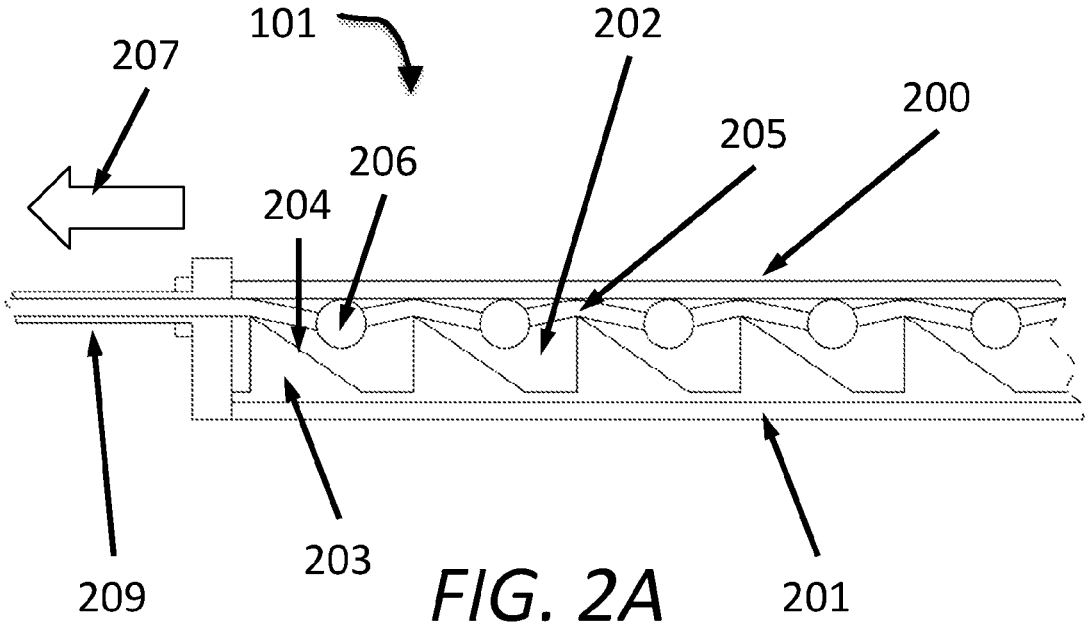
FIG. 2A is a schematic diagram illustrating an embodiment of a rail as disclosed herein.
Figure 2B:
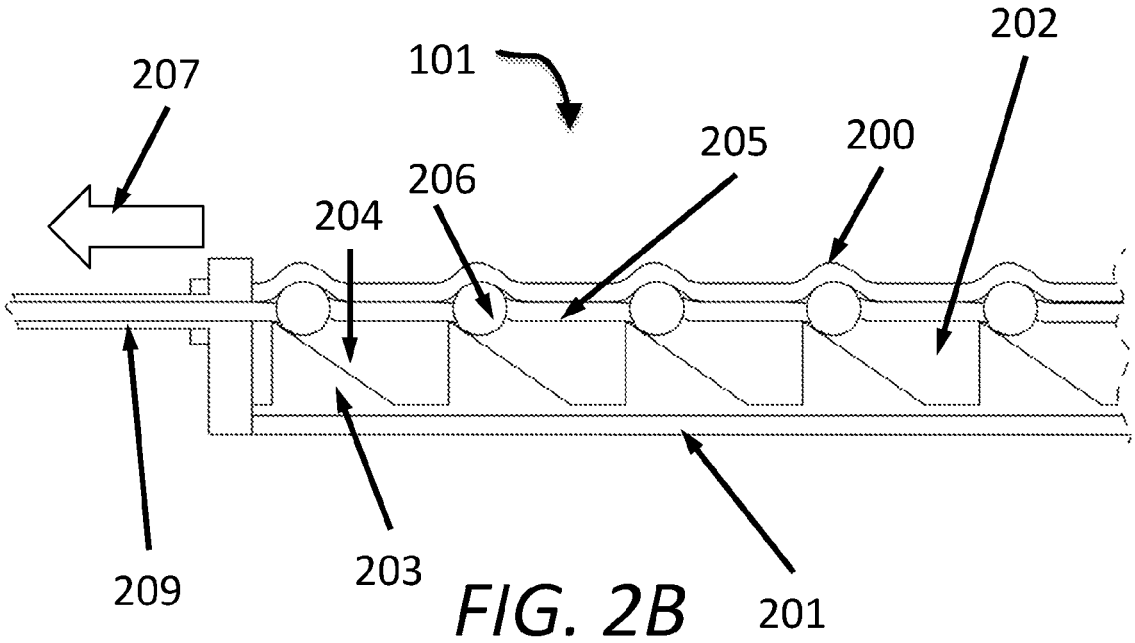
FIG. 2B is a schematic diagram illustrating an embodiment of a rail as disclosed herein.
Figure 2C:
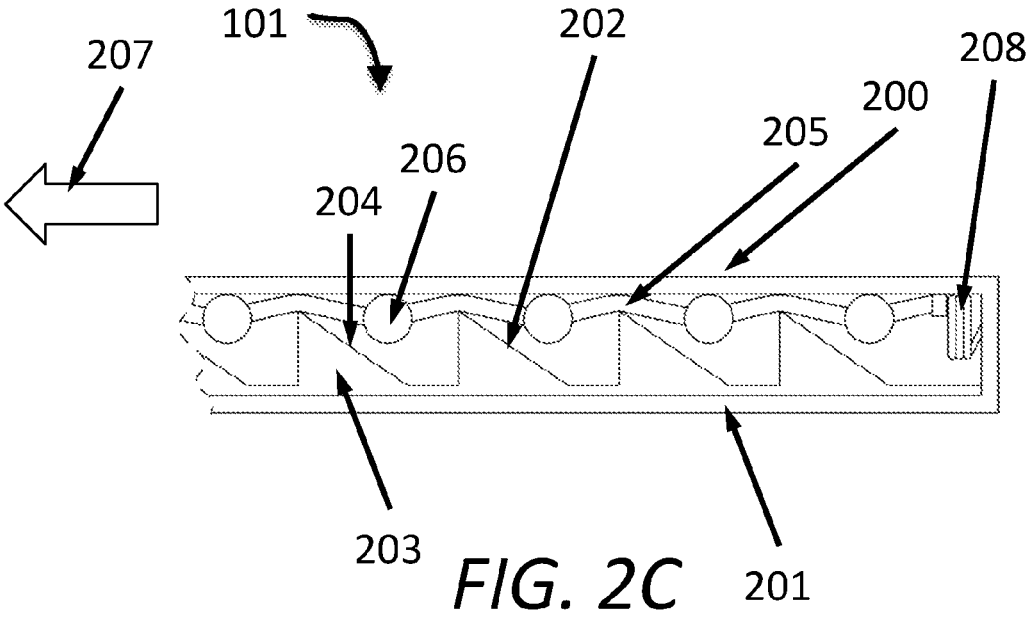
FIG. 2C is a schematic diagram illustrating an embodiment of a rail as disclosed herein.
Figure 2D:
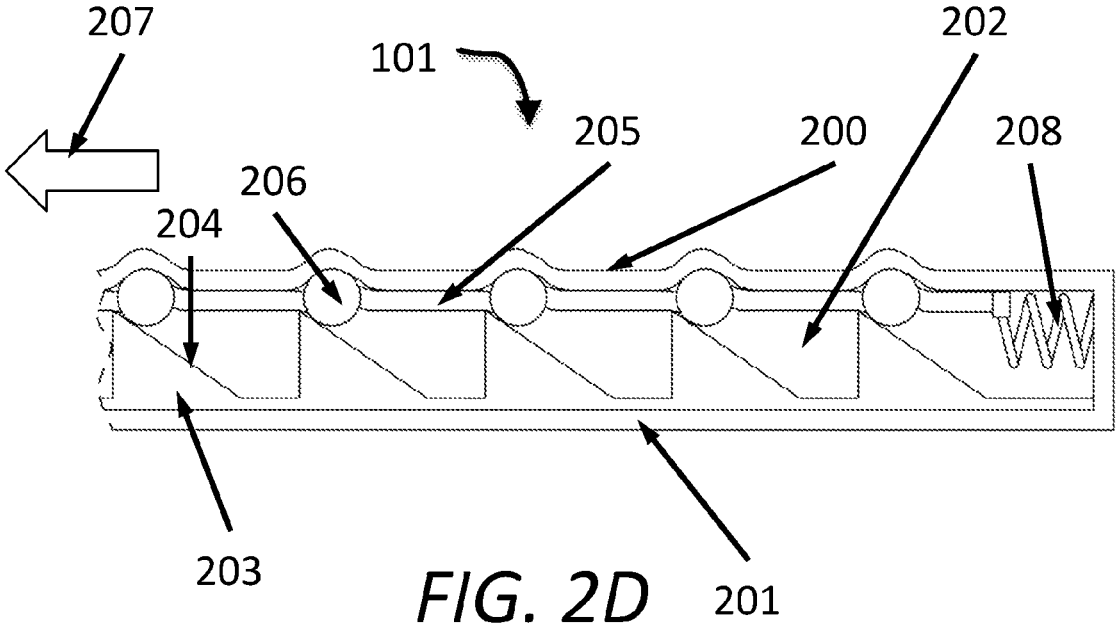
FIG. 2D is a schematic diagram illustrating an embodiment of a rail as disclosed herein.
Figure 2E:
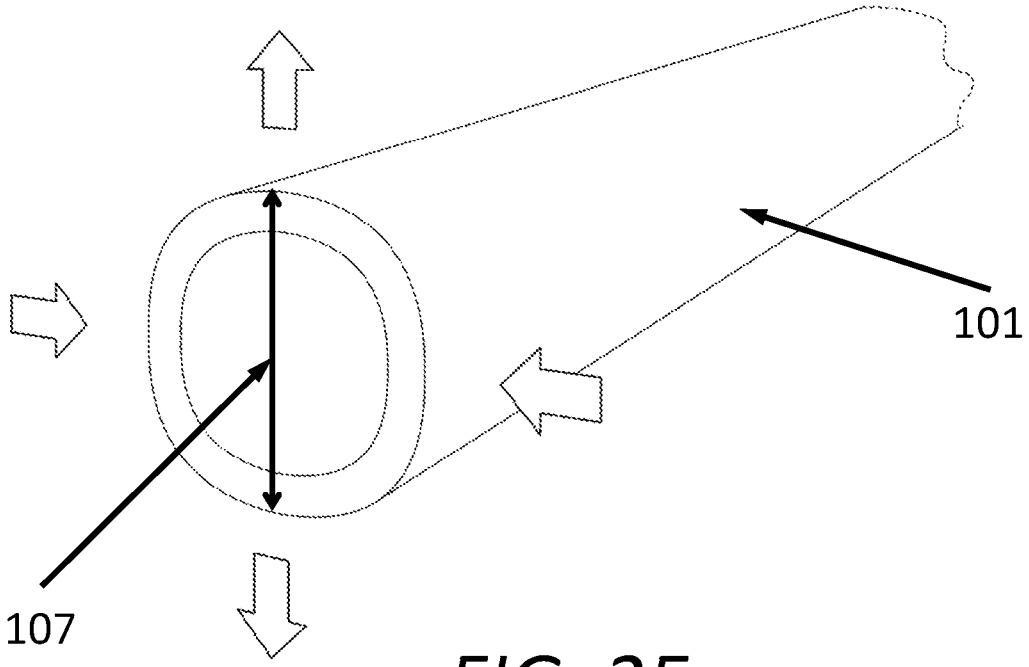
FIG. 2E is a schematic diagram illustrating an embodiment of a rail as disclosed herein.
Figure 2F:
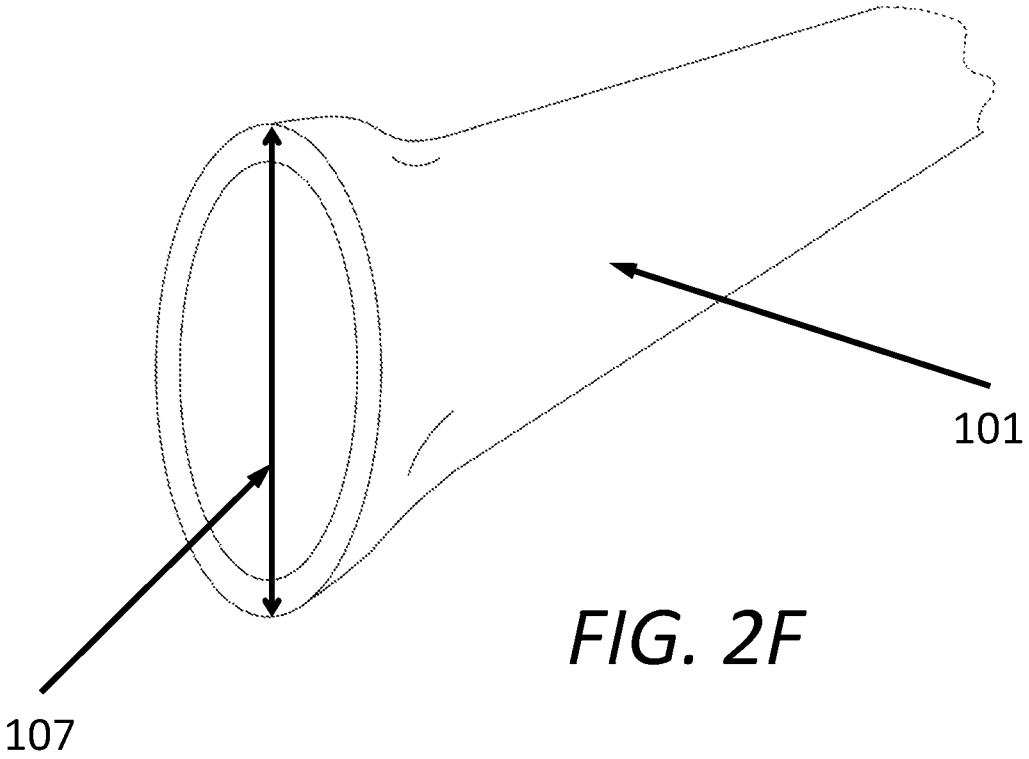
FIG. 2F is a schematic diagram illustrating an embodiment of a rail as disclosed herein.
Figure 2G:
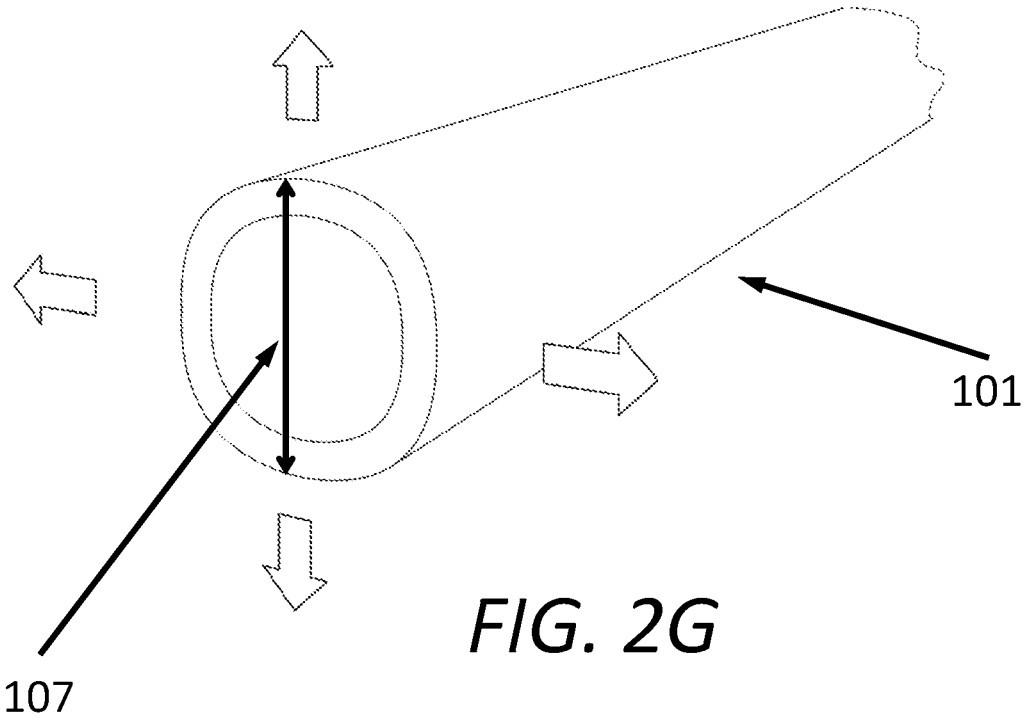
FIG. 2G is a schematic diagram illustrating an embodiment of a rail as disclosed herein.
Figure 2H:
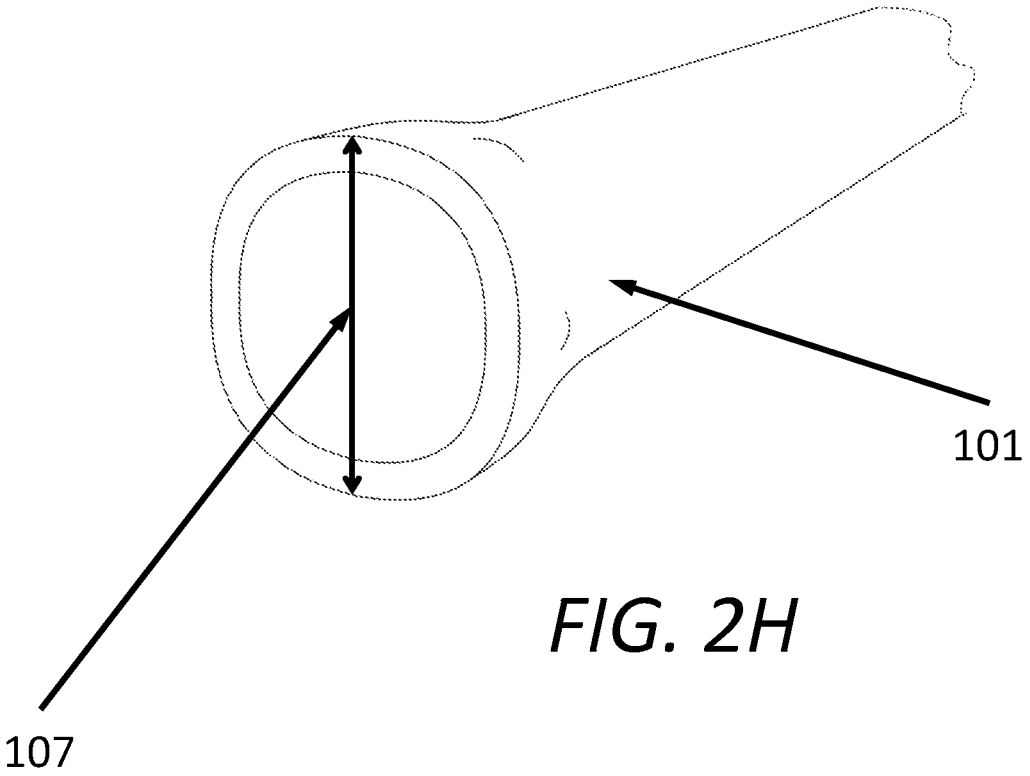
FIG. 2H is a schematic diagram illustrating an embodiment of a rail as disclosed herein.

As shown in FIGS. 2C-D, the mechanism 202 may include a biasing means 208 having a bias that tends to resist movement of the elongated member 205 in the first direction 207. The biasing means 208 may be a spring, or a piece of elastic material. The biasing means 208 may act as a return spring, so that when a force pulling the elongated member 205 in the first direction 207 is released, the biasing means 208 will pull the elongated member 205 in a second direction that is the opposite direction from the first direction; as a result, the at least one bead 206 may travel back down the at least one wedge cam 203 and the rail 101 may return to the first state.

Figure 3:
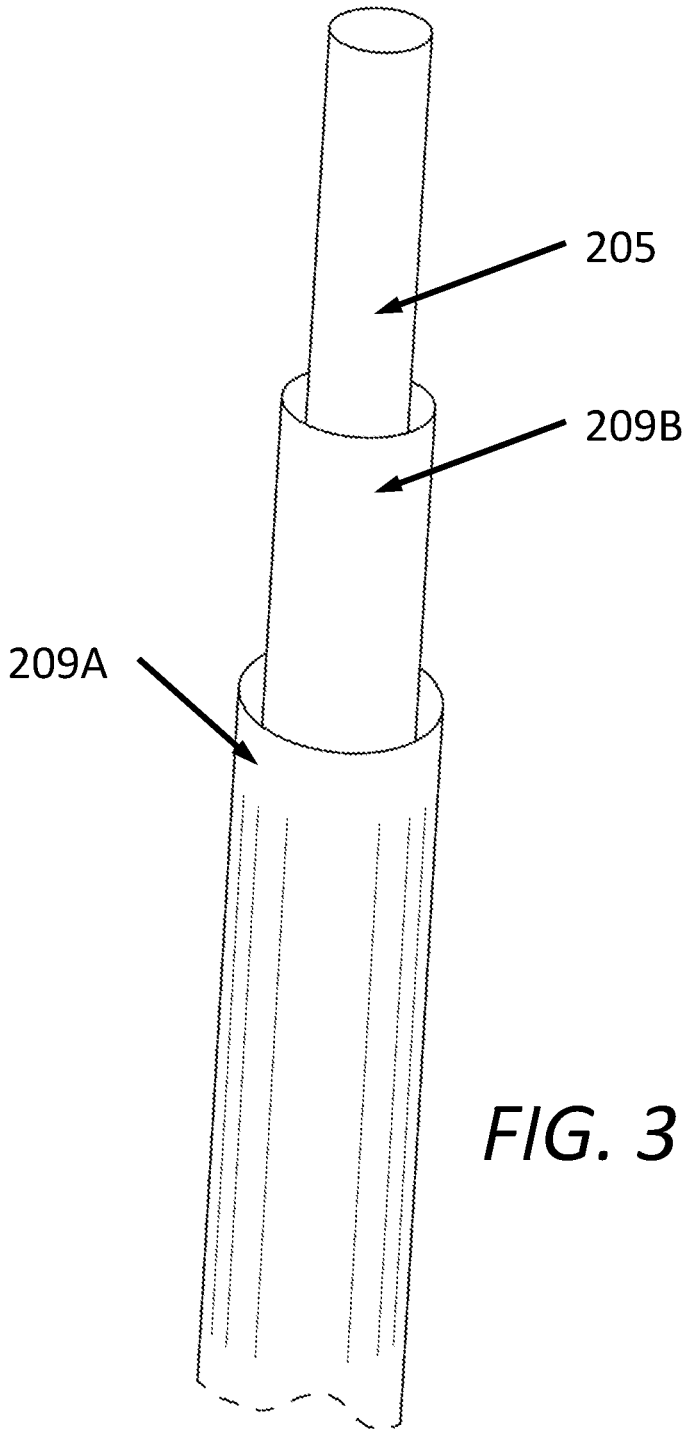
FIG. 3 is a schematic diagram illustrating an embodiment of a portion of a sheath and elongated member as disclosed herein.

In some embodiments, as shown for instance in FIGS. 2A-B, a portion of the elongated member 205 projects away from the rail 101; for instance, where the rail 101 is a tube, the elongated member may exit the tube. The locking slider assembly 100 may include a sheath 209 containing the portion of the elongated member 205 that projects away from the rail 101. The sheath 209 may be constructed from any material or combination of materials suitable for the construction of the rail 101. The sheath 209 may be flexible. The sheath 209 may be flexible but inelastic; the sheath 209 may function similarly to the sheath of a Bowden cable. For instance, as shown in FIG. 3, the sheath may include an outer layer 209*a*; the outer layer may be flexible, but sufficiently inelastic to resist longitudinal compression, so that when a mechanism attached to an end of the outer layer 209*a* pulls or pushes the elongated member 205 while pulling or pushing the outer layer 209*a* in the other direction, in a manner analogous to a bicycle brake. The outer layer 209*a* may contain winding or twined wires, or polymer material having similar properties, to add stiffness to the outer layer 209*a*. Viewing FIGS. 2A-B again, the outer layer 209*a* may be attached to the end of the rail 101 by a nut 210. The nut 210 may be adjustable to move the end of the outer layer 209*a*, modifying the length of the outer layer 209*a*; lengthening the outer layer 209*a* may have the effect of adding tension to the elongated member 205, while shortening the outer layer 209*a* may have the effect of reducing tension on the elongated member 205. The sheath 209 may also include an inner layer 209*b*. The inner layer 209*b* may have low friction, to make the elongated member move more easily within the sheath 209.

Figure 4A:
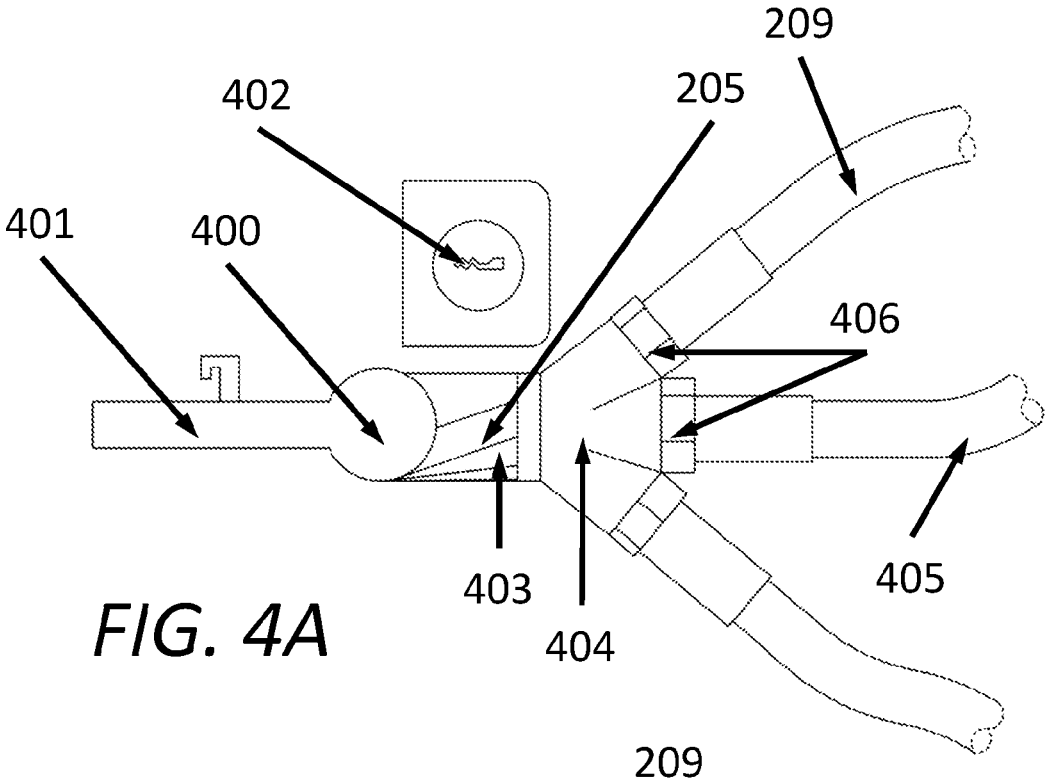
FIG. 4A is a schematic diagram illustrating an embodiment of a spool as disclosed herein.
Figure 4B:
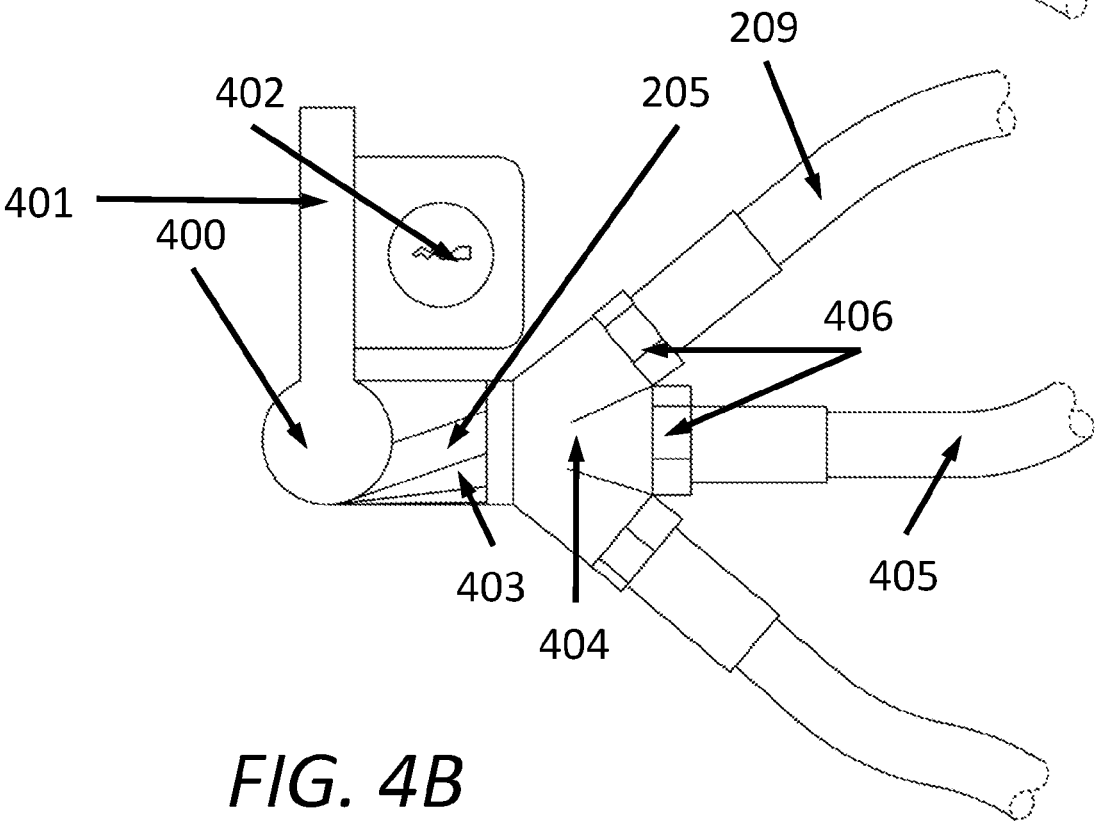
FIG. 4B is a schematic diagram illustrating an embodiment of a spool as disclosed herein.
Figure 4C:
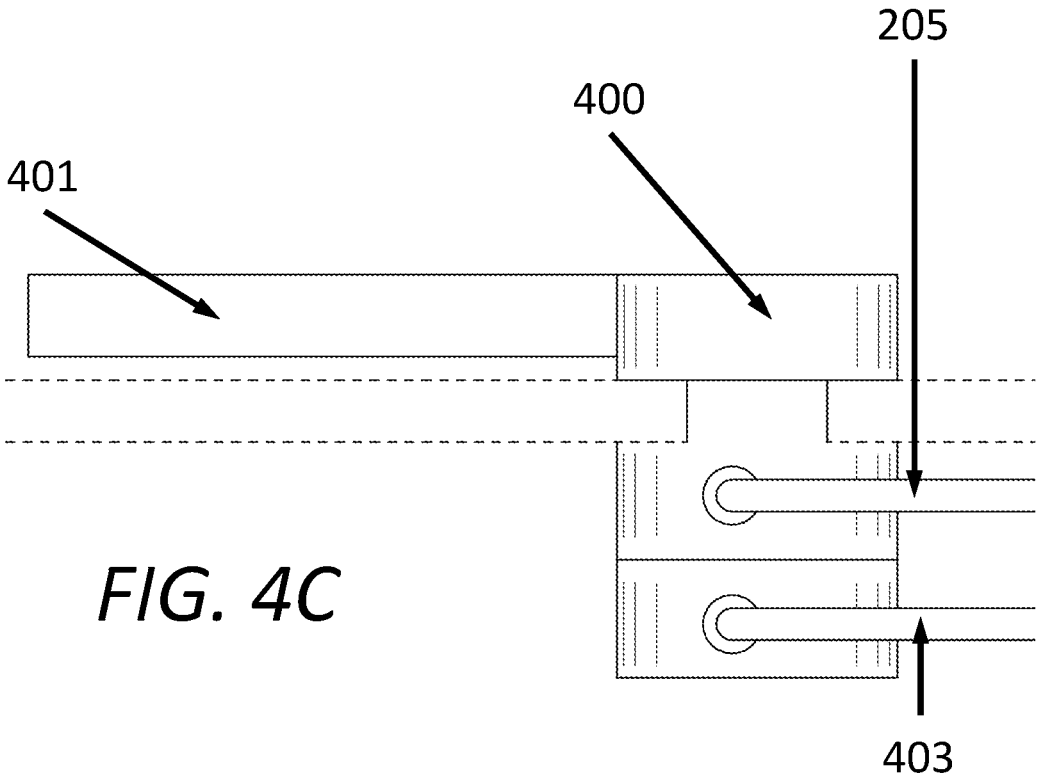
FIG. 4C is a schematic diagram illustrating an embodiment of a spool as disclosed herein.
Figure 4D:
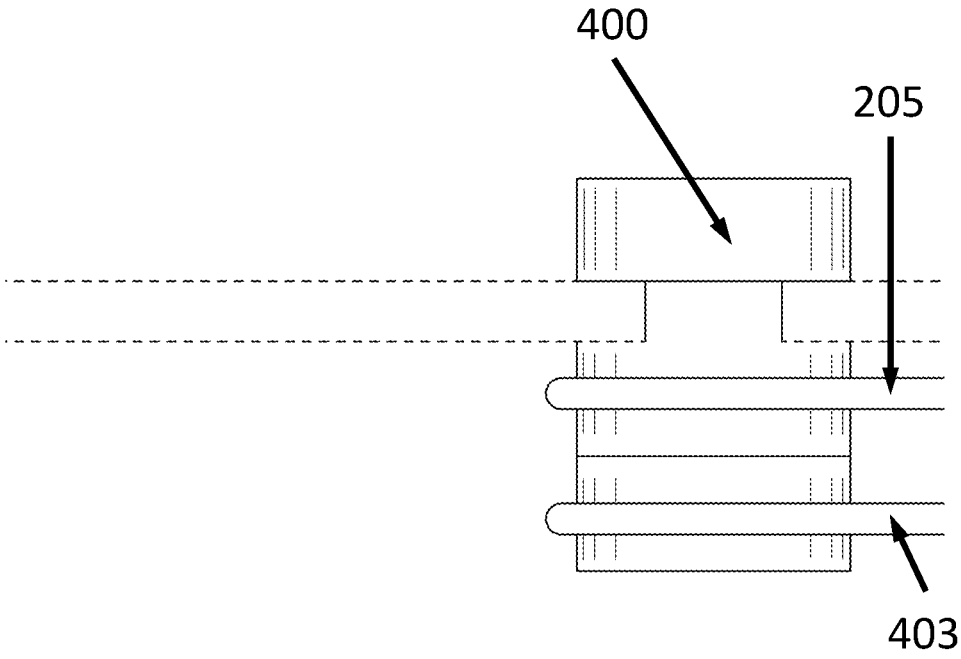
FIG. 4D is a schematic diagram illustrating an embodiment of a spool as disclosed herein.

Turning now to FIGS. 4A-B, the assembly 100 may include a spool 400 to which one end of the elongated member 205 is fixed, so that rotating the spool to a locking position causes the elongated member 205 to slide in the first direction. The spool 400 may be substantially cylindrical, so that the elongated member 205 winds onto the spoon in a similar manner to a cable on a winch or a sewing thread on a sewing thread spool. In some embodiments, rotating the spool from the unlocked position shown in FIG. 4A to the locked position shown in FIG. 4B causes the elongated member 205 to wind onto the spool, pulling the elongated member 205 in the first direction, and putting the rail 101 in the second state. This is illustrated for example in FIGS. 4C-D: FIG. 4C illustrates an embodiment of the spool 400 as seen from the side with an end the elongated member 205 attached to it, and FIG. 4C illustrates the same embodiment with the spool 400 rotated, and the elongated member 205 wound around the substantially cylindrical spool, pulling the elongated member 205 in the desired direction. A user may turn the spool 400 to the locking position or the unlocking position by manipulating a lever 401 or similar manual interface device. In some embodiments, the assembly 100 includes a latch 402 that secures the spool 400 in the locking position. The latch 402 may attach to a projection from the lever 401. The latch 402 may be opened by a button or switch; alternatively the latch 402 may include a lock, which may function in any suitable way, and may include, without limitation, a combination lock or a lock that accepts a key.

Figure 5A:
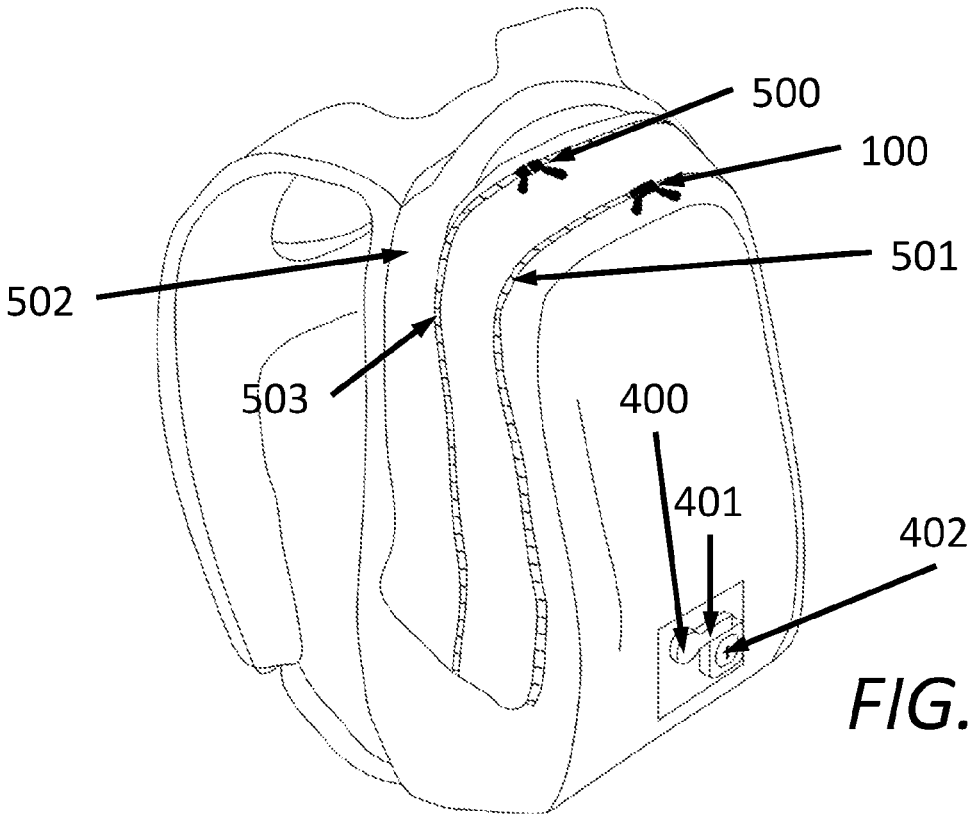
FIG. 5A is a schematic diagram illustrating an embodiment of a backpack incorporating an embodiment of the locking slider assembly as disclosed herein.
Figure 5B:
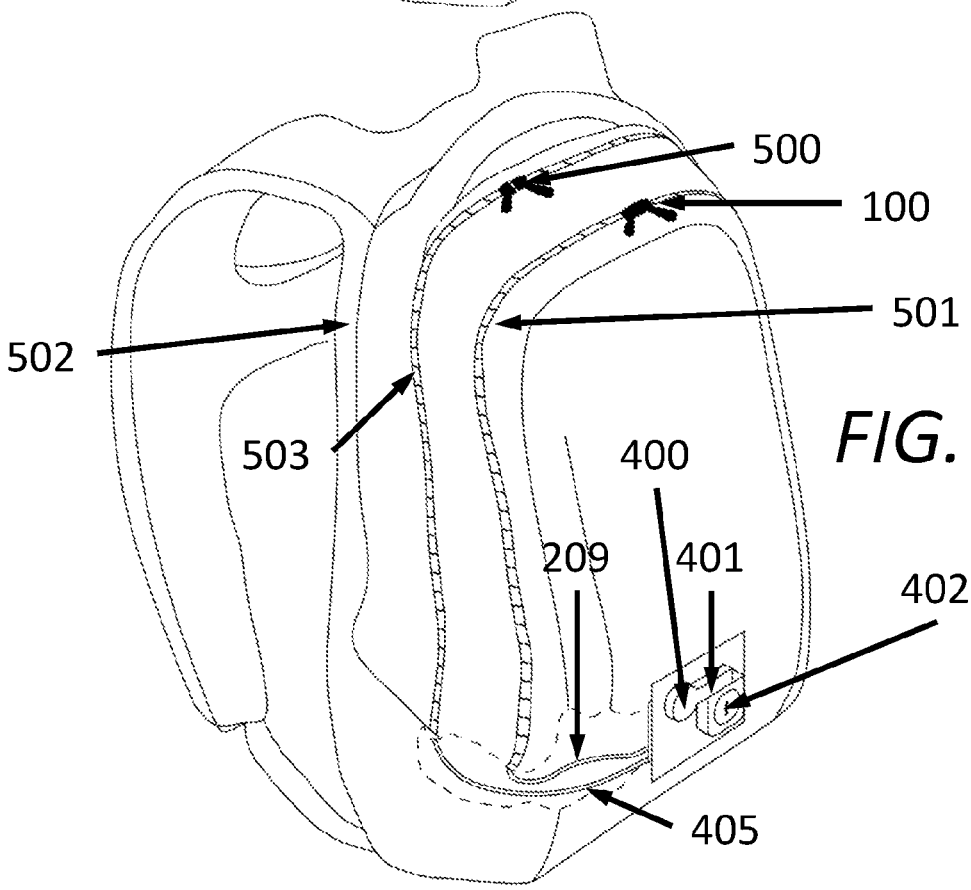
FIG. 5B is a schematic cutaway diagram illustrating an embodiment of a backpack incorporating an embodiment of the locking slider assembly as disclosed herein.
Figure 5C:
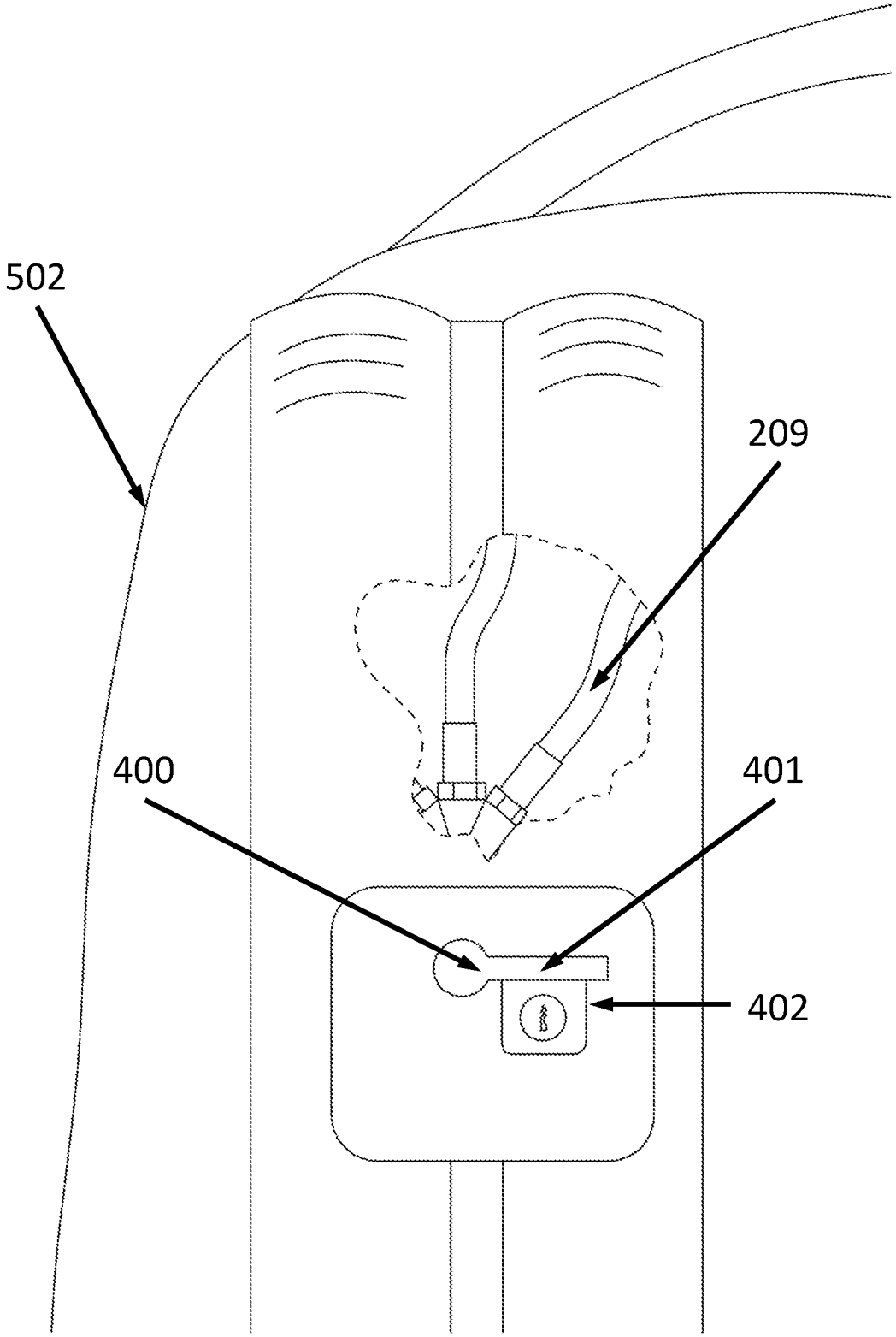
FIG. 5C is a schematic diagram illustrating an embodiment of a backpack incorporating an embodiment of the locking slider assembly as disclosed herein.
Figure 5D:
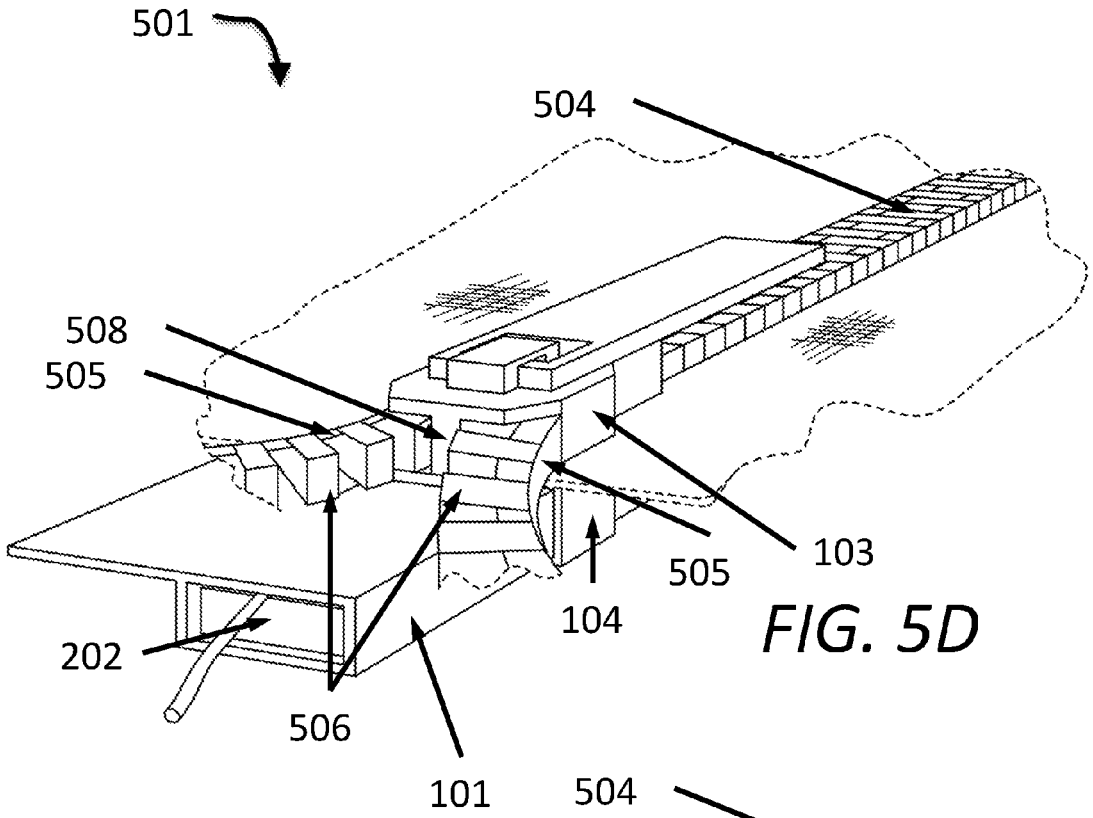
FIG. 5D is a schematic diagram illustrating an embodiment of a slide fastener incorporating an embodiment of the locking slider assembly as disclosed herein.
Figure 5E:
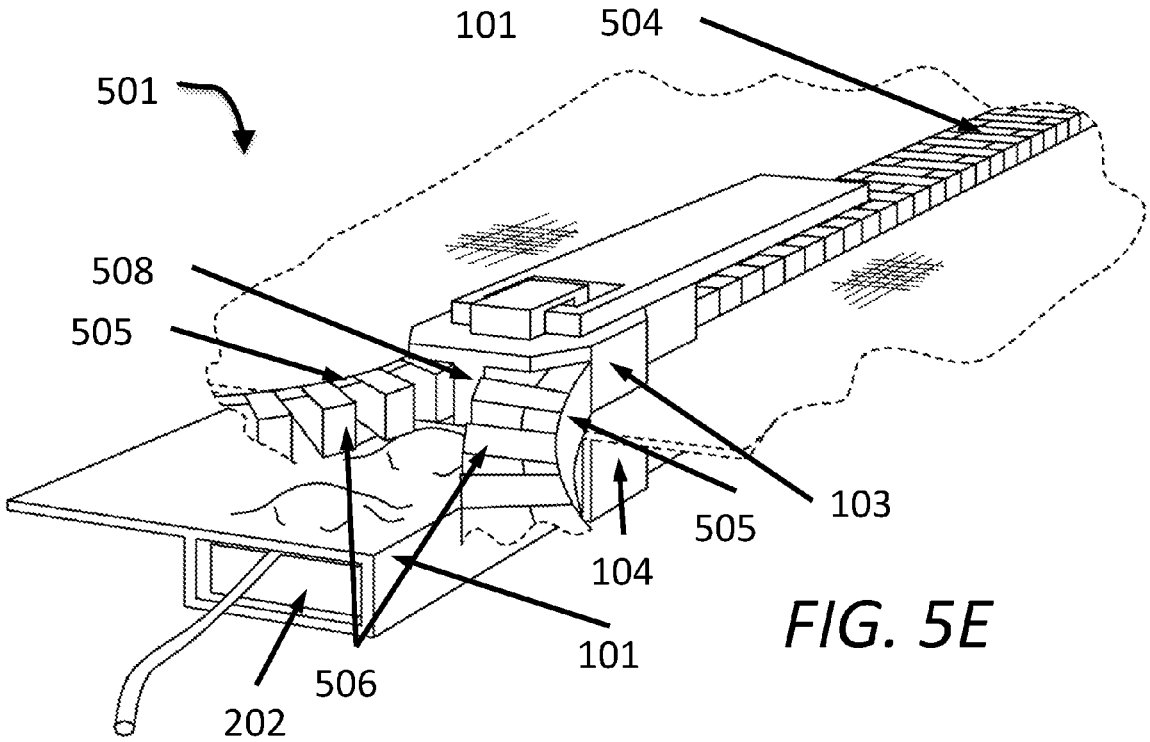
FIG. 5E is a schematic diagram illustrating an embodiment of a slide fastener incorporating an embodiment of the locking slider assembly as disclosed herein.

In some embodiments, a second elongated member 403 is also attached to the spool 400; the second elongated member 403 may be attached so that turning the spool to the locking position pulls the second elongated member toward the spool. In some embodiments, as shown for example in FIGS. 5A-B, the second elongated member 403 may be part of a second assembly 500; for instance, the first assembly 100 may be included in a first zipper 501 on a backpack 502, and the second assembly 500 may be included in a second zipper 503. As shown in FIG. 5C, the spool 400 may be mounted on a shoulder strap of the backpack 502, with the sheathed cable or cables 209 running through the strap into the backpack 502, for instance to connect with slide fasteners that close the backpack. FIGS. 5D-E illustrate how the assembly 100 or the second assembly 500 may be incorporated in a slide fastener, such as a zipper, as set forth in further detail below. The second assembly 500 may any assembly suitable for use as the first assembly 100 as described above in connection with FIGS. 1A-4D. The spool may have three or more elongated members attached to it. Returning to FIGS. 4A-B, the assembly 100 may include a splitter 404 that divides the elongated member and the second elongated member. The sheath 209 may attach to the splitter; a second sheath 405 may attach to the splitter, containing the second elongated member 403 as described above. Each sheath may attach to the splitter by way of a nut 406; as described above in connection with FIGS. 2A-3, the nuts 406 may be tightened or loosened to adjust the tension on the elongated members 205, 403.

Returning to FIGS. 1A-F, the assembly includes a slider 103. The slider may be made of any rigid material; for instance, the slider 103 may be constructed from metal. The slider 103 includes a slot 104 that fits over the rail 101. The slot 104 may have a cross-sectional shape that is substantially the same as the cross-sectional shape of the rail 101. For instance, where the rail 101 has a substantially rectangular cross-sectional shape as described above in reference to FIGS. 1A-2D, the slot 104 may be substantially rectangular; that is, the slot 104 may have a substantially rectangular shape that is open at one end, such as a substantially rectangular C-shaped profile, with the upper surface 105 forming the underside of the top of the C, and the lower surface 106 forming the top side of the bottom of the C. The slot 104 may fit snugly over the rail 101 when the rail is in the first state. The slot has a first surface 105 and a second surface 106. The first surface 105 and second surface 106 are separated by a distance aligned with the cross-sectional dimension 107 that is greater than the first value of the cross-sectional dimension and less than or equal to the second value of the cross-sectional dimension; for example, the distance between the first surface 105 and second surface 106 may be almost the same height as the first height of the rail 101, when in the first state. When the rail 101 is in the second state, the slot 104 may be stuck between two lumps in the rail; in other embodiments, the rail may hold the slot 104 by creating friction between the slot and the upper and lower surfaces of the rail 101 by expanding within the slot 104 when the rail is in the second state.

Returning to FIGS. 5A-5H, the slider locking assembly 100 may be incorporated in a slide fastener 501. As an example, FIGS. 5C-E illustrate an embodiment of a slide fastener 501 incorporating a slider locking assembly. The slide fastener 501 may include a fastener 504 having two flexible strips 505 and a set of interlocking teeth 506 alternately attached to the two flexible strips. The fastener 504 may be any fastener suitable for use in a slide fastener or zipper. The flexible strips 505 may be constructed from any flexible material as described above in reference to FIGS. 1A-2D. The flexible strips may have any suitable shape for use in a slide fastener. In some embodiments, the flexible strips 505 are attached to two sheets or panels 507;

the sheets or panels 507 may be part of a garment, bag, backpack, luggage item, or other product on which a slide fastener of zipper is useful for joining the edges of two sheets or panels. The sheets or panels may be constructed of any flexible or rigid materials as described above in reference to FIGS. 1A-2D. The teeth 506 may have any form suitable for use in a slide fastener; the teeth may be substantially rectangular. The teeth 506 may have interlocking projections and indentations. The teeth 506 may have regular or irregular polyhedral forms that interlock. The teeth 506 may be formed individually from rigid material such as metal or plastic and attached independently to the flexible strips 505. In other embodiments, the teeth 506 are formed from a coiled filament or wire of material such as nylon, and flattened at certain points to enable them to interlock. Persons skilled in the art will be aware of many ways to construct fasteners having interlocking teeth attached to strips of flexible material.

The slide fastener 501 may include a rail 101 having a travel direction, the rail switchable between a first state in which the rail has a first height substantially orthogonal to the travel direction and a second state in which the rail has a second height substantially orthogonal to the travel direction, the second height greater than the first height. The rail 101 may be any rail as described above in reference to FIGS. 1A-2D. The rail 101 may be manufactured separately from the fastener 504, and subsequently attached to the fastener 504; for instance, as shown in FIG. 5E, the rail 101 may have a projecting strip 101*a* that may be attached to one of the flexible strips or to one of the sheets or panels 507 to which the flexible strips are attached. The projecting strip 101*a* may be attached by any suitable process, including without limitation adhesion, heat sealing, or sewing. The rail 101 may be attached on the underside of the slide fastener 501; that is, where the slide fastener 501 closes an opening in an object, such as a backpack, luggage item, pocket, or garment, which has an interior or exterior, the rail 101 may be attached on the interior side of the slide fastener 501. The rail 101 may be attached to run parallel to the fastener 504 when the teeth of the fastener 504 are interlocked, as shown in FIGS. 5C-D.

Figure 5F:
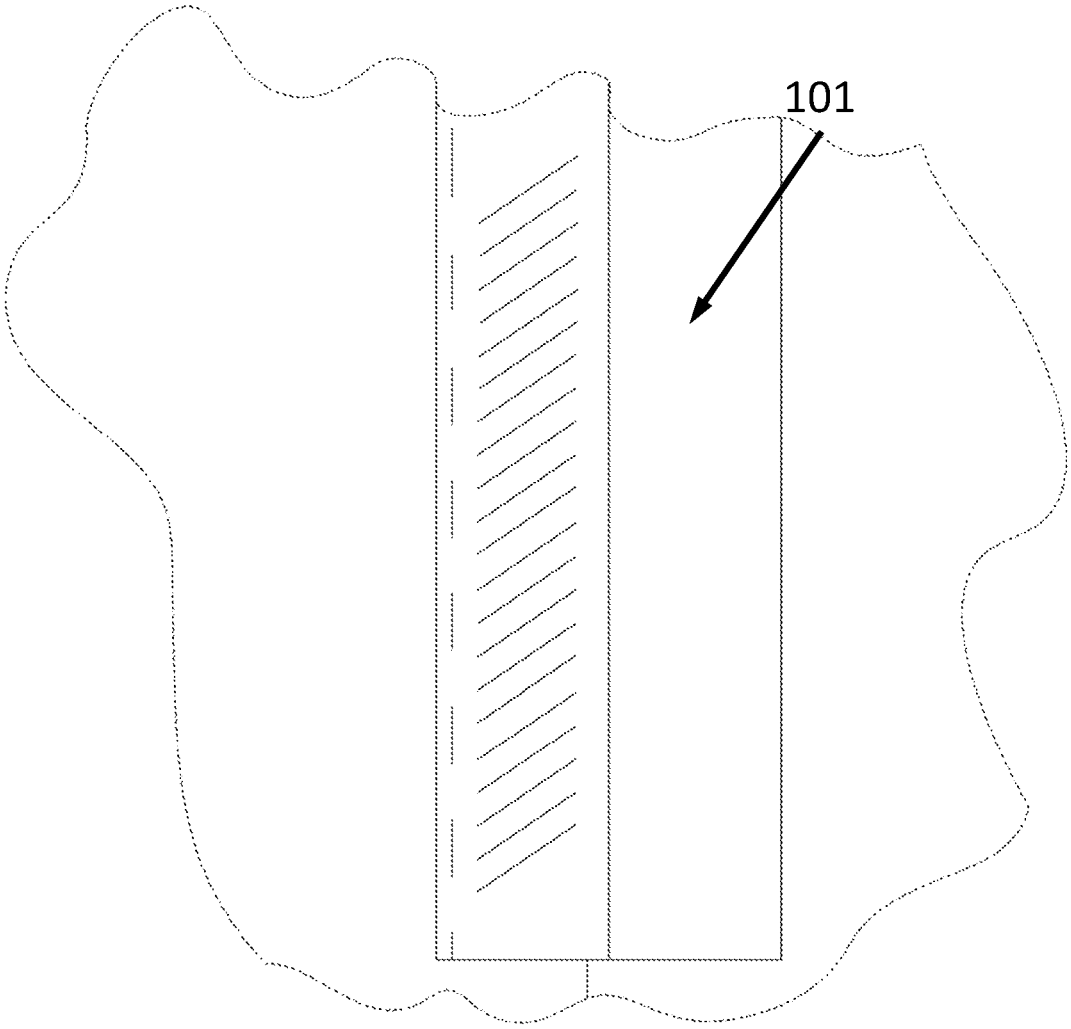
FIG. 5F is a schematic diagram illustrating an embodiment of a slide fastener incorporating an embodiment of the locking slider assembly as disclosed herein.
Figure 5G:
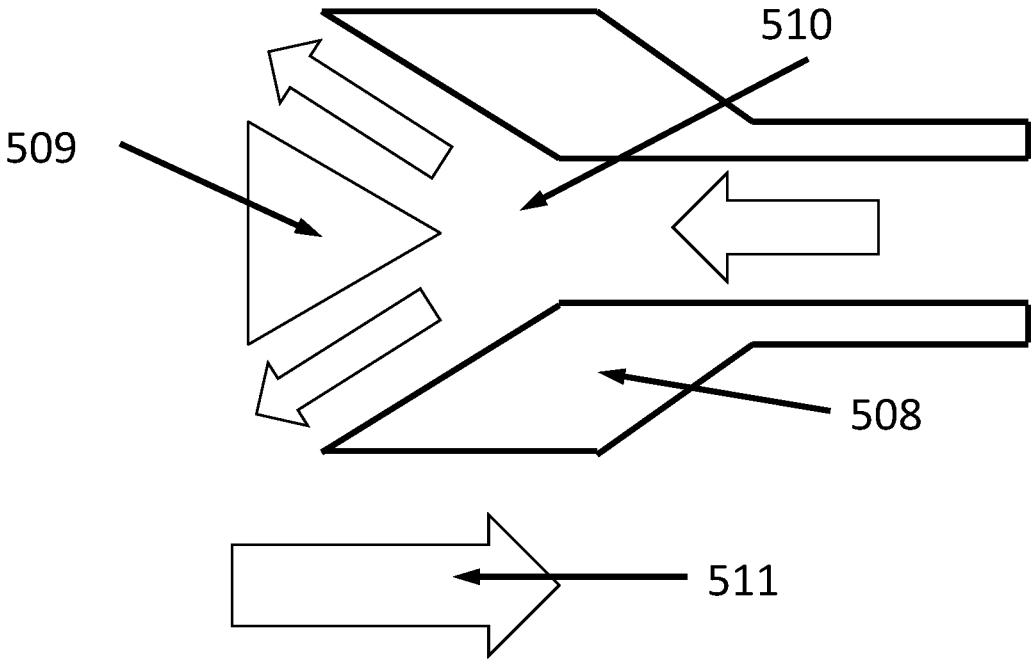
FIG. 5G is a schematic diagram illustrating an embodiment of a slider mechanism as disclosed herein.
Figure 5H:
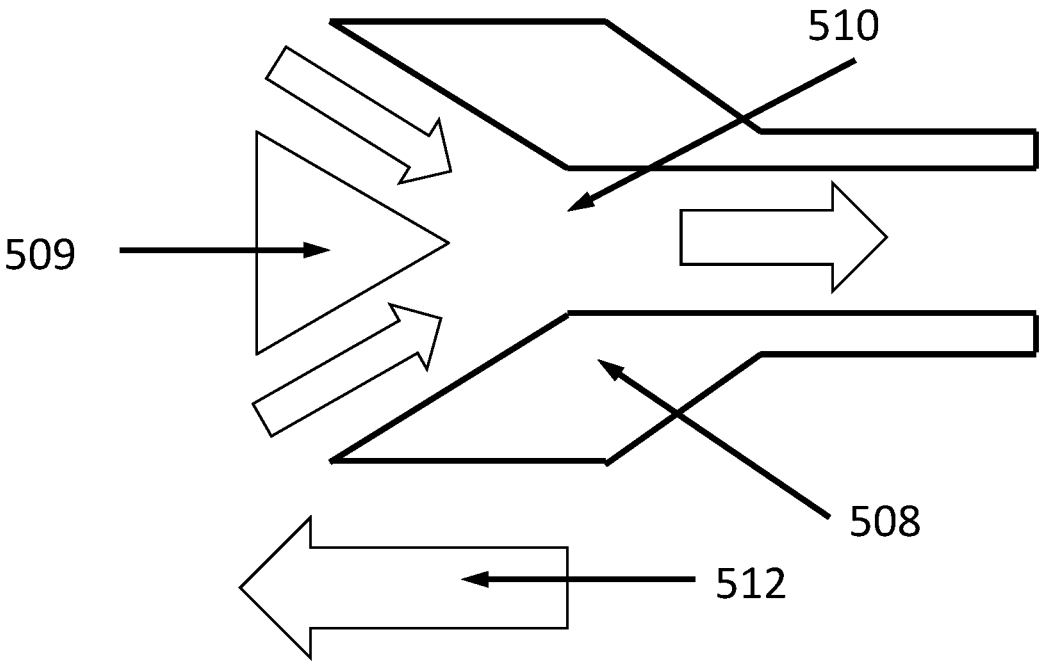
FIG. 5H is a schematic diagram illustrating an embodiment of a slider mechanism as disclosed herein.

The slide fastener 501 may include a slider 103. The slider 103 may include a slot 104 that fits over the rail 101, the slot 104 having an upper surface over the rail and a lower surface under the rail, the slot having a distance between the upper surface and lower surface, the distance being greater than the first height and less than the second height, as described above in reference to FIGS. 1A-2D. The slider 103 may be slidably engaged to the fastener 504. The slider 103 may have a mechanism 508 that separates the interlocking teeth when the slider slides in a first direction and interlocks the interlocking teeth when the slider slides in a second direction. As illustrated in FIGS. 5F-G, the mechanism 508 may combine a wedge 509 with a y-shaped junction 510. When the slider, and therefore the mechanism 508, travels in the first direction 511, the teeth may move in the opposite direction as illustrated in FIG. 5F; the wedge 509 may part the teeth so that they pass through the two parted branches of the Y-junction 510. When the slider, and therefore the mechanism 508, travel in the second direction 512, the teeth may travel through the slider in a direction opposite to the second direction 512, and the Y-junction 510 may force the teeth to intermesh as they enter the stem of the Y-shaped passage 510. Persons skilled in the art will be aware of various ways to implement such a mechanism.

In some embodiments, the incorporation of the locking slider assembly 100 in the slide fastener 501 results in a slide fastener 501 that may be locked, preventing the slider 103 from moving along the fastener 504 and parting or enmeshing the teeth, when the rail 101 is in the second state. Thus, a user may be able to lock the slide fastener 504 when it is entirely or partially closed; the user may do so using the spool 400 and handle 401 as illustrated in FIGS. 4A-B and 5A-B. The user may latch the spool 400 so that the slide fastener 501 cannot be opened until the spool 400 is unlatched; where the latch incorporates a lock, the slide fastener 501 may be impossible to open in the conventional way until the spool is unlocked. As a result, the user may be able to secure the slide fastener 501 thoroughly, quickly, and easily, protecting any valuable object enclosed by the slide fastener 501.

Figure 6:
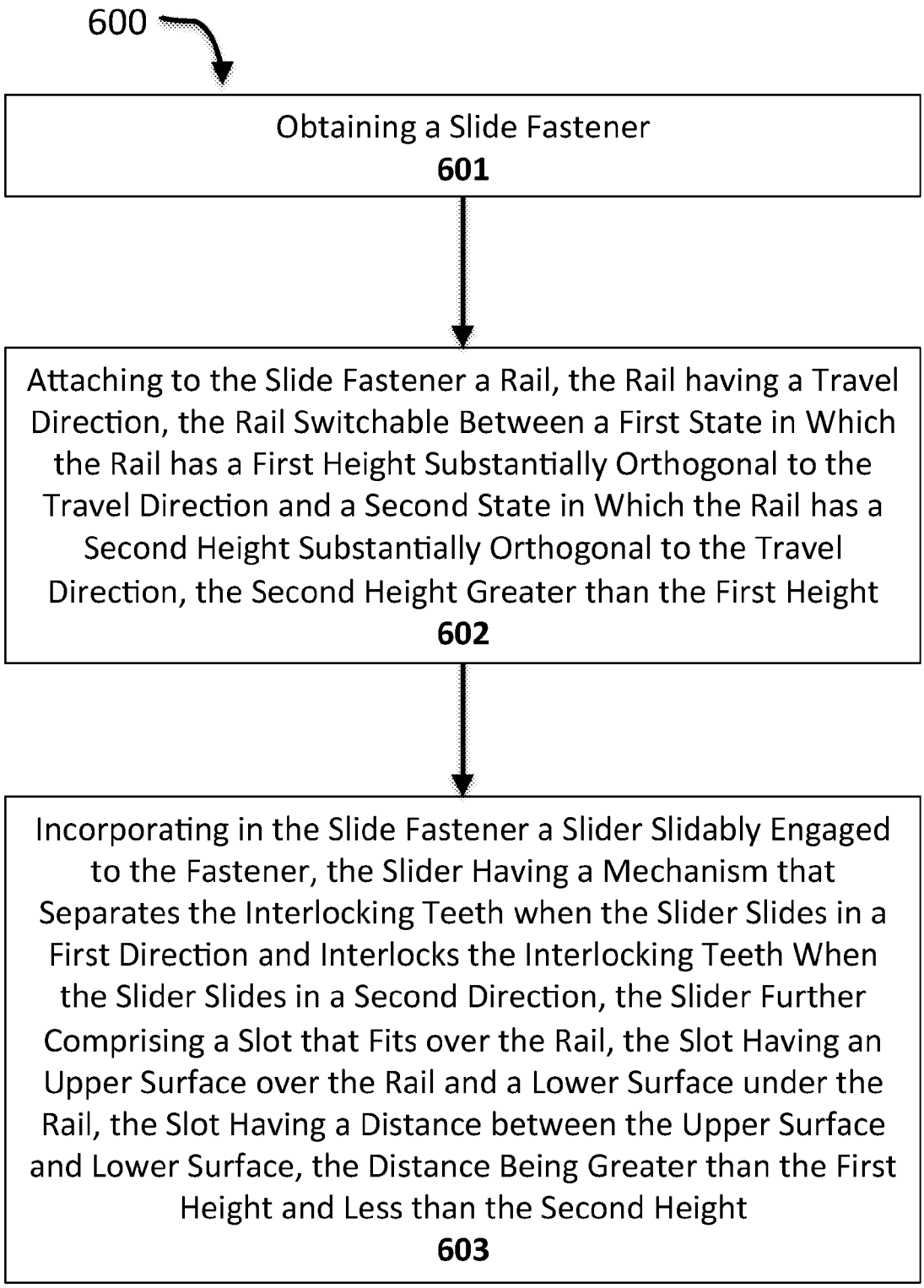
FIG. 6 is a flow diagram illustrating one embodiment of a method for manufacturing a slide fastener incorporating an embodiment of the locking slider assembly as disclosed herein.

FIG. 6 illustrates some embodiments of a method 600 for manufacturing a slide fastener having a locking slider assembly. The method 600 includes obtaining a slide fastener (601). The method 600 includes attaching to the slide fastener a rail, the rail having a travel direction, the rail switchable between a first state in which the rail has a first height substantially orthogonal to the travel direction and a second state in which the rail has a second height substantially orthogonal to the travel direction, the second height greater than the first height (602). The method 600 includes incorporating in the slide fastener a slider slidably engaged to the fastener, the slider having a mechanism that separates the interlocking teeth when the slider slides in a first direction and interlocks the interlocking teeth when the slider slides in a second direction, the slider further comprising a slot that fits over the rail, the slot having an upper surface over the rail and a lower surface under the rail, the slot having a distance between the upper surface and lower surface, the distance being greater than the first height and less than the second height.

Referring to FIG. 6 in greater detail, and by reference to FIGS. 1A-5G, the method 600 includes obtaining a slide fastener (601). The slide fastener may be any slide fastener as described above in connection with FIGS. 5A-G. In some embodiments, obtaining the slide fastener involves purchasing or otherwise sourcing a slide fastener from another party; the slide fastener thus obtained may include the fastener 504. In some embodiments, the slide fastener thus sourced includes a slider having a mechanism 508 as described above for parting or enmeshing the interlocking teeth; in other embodiments the slide fastener 501 includes only the fastener 504. In other embodiments, obtaining the slide fastener 501 includes manufacturing the slide fastener 501 or one or more components of the slide fastener. The method 600 may include incorporating the slide fastener 501 in a product such as a backpack, luggage item, handbag, or article of clothing; the flexible strips 505 may be sewn or otherwise attached to the product.

The method 600 includes attaching to the slide fastener a rail, the rail having a travel direction, the rail switchable between a first state in which the rail has a first height substantially orthogonal to the travel direction and a second state in which the rail has a second height substantially orthogonal to the travel direction, the second height greater than the first height (602). The rail 101 may be any rail 101 as described above in reference to FIGS. 1A-5G. In some embodiments, this includes manufacturing the rail 101. The rail 101 may be extruded or otherwise formed from polymer material in a manner analogous to the formation of plastic or rubber tubing. The rail 101 may be attached to the slide fastener 501 as shown in FIGS. 5A-G; the rail 101 may be attached before or after the slide fastener 501 is incorporated in the product.

The method 600 may include incorporating the mechanism 202 in the rail; where the rail 202 includes a tube, this may include inserting the wedge cams 203 in the rail 101. This may include inserting a strip bearing the wedge cams 203 inside the rail; the strip or individual wedge cams 203 may be adhered or otherwise attached to the interior surface of the tube. The elongated member 205 may be inserted over the wedge cams 203 in the tube; in some embodiments the elongated member 205 and wedge cams 203 are inserted together. The method 600 may include placing the biasing means 208 at one end of the rail; an end cap or other element bearing the biasing means may be attached.

The method 600 includes incorporating in the slide fastener a slider slidably engaged to the fastener, the slider having a mechanism that separates the interlocking teeth when the slider slides in a first direction and interlocks the interlocking teeth when the slider slides in a second direction, the slider further comprising a slot that fits over the rail, the slot having an upper surface over the rail and a lower surface under the rail, the slot having a distance between the upper surface and lower surface, the distance being greater than the first height and less than the second height. The slider 103 may be any slider 103 as described above in reference to FIGS. 1A-5G. In some embodiments, incorporating the slider 103 involves attaching a slot 104 to an existing slider 103, such as a slider that came with the slide fastener 501 if the slide fastener is sourced from another party; in other embodiments, the slider 103 with the slot 104 is manufactured by methods that may include without limitation molding, machining, or rapid prototyping. Incorporating the slider 103 may include inserting the teeth 506 of the fastener 504 in the mechanism of the slider 103. Incorporating the slider 103 may include inserting the rail 101 in the slot of the slider 103.

The method may include attaching the end of the elongated member to the spool 400; in some embodiments, the spool is manufactured, for instance by molding, machining, or rapid prototyping. The spool 400 and latch 402 may be assembled together; the spool 400 and latch 402 may be incorporated in the product before or after they are assembled together. The spool 400 and latch 402 may be incorporated in the product before or after the end of the elongated member 205 is attached to the spool.

The method may include inserting the elongated member in a sheath 209. The elongated member may be tensioned as described above by adjusting one or more nuts on the ends of the sheath. The sheath 209 may be attached to the rail by a nut. The sheath 209 may be attached to the spool 400 by way of a splitter 500 as described above.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A locking slider assembly comprising:

a rail having a travel direction and a cross-sectional dimension, the rail switchable between a first state in which the cross-sectional dimension has a first value and a second state in which the cross-sectional dimension has a second value, the second value greater than the first value; and a slider comprising a slot that fits over the rail, the slot having a first surface and a second surface, the first surface and second surface separated by a distance aligned with the cross-sectional dimension that is greater than the first value of the cross-sectional dimension and less than or equal to the second value of the cross-sectional dimension, so that the slot can slide over the rail when the rail is in the first state, and the slot cannot slide over the rail when the rail is in the second state.

2. The assembly of claim 1, wherein the rail further comprises:

a top surface;

a bottom surface; and a mechanism disposed between the top surface and bottom surface that pushes the top and bottom surfaces apart to change the rail to the second state.

3. The assembly of claim 2, wherein the rail further comprises a tube having an exterior including the top surface and bottom surface and an interior containing the mechanism.

4. The assembly of claim 2, wherein at least one of the top surface and the bottom surface is composed of flexible material.

5. The assembly of claim 2, wherein the mechanism further comprises:

at least one wedge cam having a cam face forming an angle with the top surface or the bottom surface; and an elongated member having at least one bead, the elongated member slidable over the at least one wedge cam, so that sliding the elongated member in a first direction causes the at least one bead to travel up the wedge cam and push the upper surface and lower surface apart.

6. The assembly of claim 5, wherein the at least one bead further comprises a plurality of beads.

7. The assembly of claim 5, wherein the at least one wedge cam further comprises a plurality of wedge cams.

8. The assembly of claim 5, wherein the elongated member is flexible.

9. The assembly of claim 8, further comprising a spool to which one end of the elongated member is fixed, so that rotating the spool to a locking position causes the elongated member to slide in the first direction.

10. The assembly of claim 9 further comprising a latch that secures the spool in the locking position.

11. The assembly of claim 9 further comprising a second locking assembly having a second elongated member, and wherein the second elongated member is also attached to the spool.

12. The assembly of claim 11, further comprising a splitter dividing the elongated member and the second elongated member.

13. The assembly of claim 8 wherein a portion of the elongated member projects away from the rail.

14. The assembly of claim 8, further comprising a sheath containing the portion of the elongated member that projects away from the rail.

15. The assembly of claim 14, wherein the sheath is flexible.

16. The assembly of claim 1, wherein the slot is formed by a substantially C-shaped projection attached to the slider.

17. The assembly of claim 1, wherein the rail has a cross-sectional shape, and the slot has a cross-sectional shape that is substantially the same as the cross-sectional shape of the rail.

18. The assembly of claim 1, wherein the slot fits snugly over the rail when the rail is in the first state.

19. A slide fastener incorporating a locking slider assembly, the slide fastener comprising:

a fastener comprising two flexible strips and a set of interlocking teeth alternately attached to the two flexible strips;

a rail having a travel direction and a cross-sectional dimension, the rail switchable between a first state in which the cross-sectional dimension has a first value and a second state in which the cross-sectional dimension has a second value, the second value greater than the first value; and a slider slidably engaged to the fastener, the slider having a mechanism that separates the interlocking teeth when the slider slides in a first direction and interlocks the interlocking teeth when the slider slides in a second direction, the slider further comprising a slot that fits over the rail, the slot having a first surface and a second surface, the first surface and second surface separated by a distance aligned with the cross-sectional dimension that is greater than the first value of the cross-sectional dimension and less than or equal to the second value of the cross-sectional dimension, so that the slot can slide over the rail when the rail is in the first state, and the slot cannot slide over the rail when the rail is in the second state.

20. A method for manufacturing a locking slider assembly, the method comprising:

obtaining a slide fastener;

attaching to the slide fastener a rail, the rail having a travel direction and a cross-sectional dimension, the rail switchable between a first state in which the cross-sectional dimension has a first value and a second state in which the cross-sectional dimension has a second value, the second value greater than the first value; and incorporating in the slide fastener a slider slidably engaged to the fastener, the slider having a mechanism that separates the interlocking teeth when the slider slides in a first direction and interlocks the interlocking teeth when the slider slides in a second direction, the slider further comprising a slot that fits over the rail, the slot having a first surface and a second surface, the first surface and second surface separated by a distance aligned with the cross-sectional dimension that is greater than the first value of the cross-sectional dimension and less than or equal to the second value of the cross-sectional dimension.

* * * * *